US006485206B1

(12) United States Patent
Takahashi

(10) Patent No.: US 6,485,206 B1
(45) Date of Patent: Nov. 26, 2002

(54) CASSETTE AND DETECTING DEVICE FOR INSTALLATION THEREOF

(75) Inventor: Toshihiro Takahashi, Kasugai-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 9 days.

(21) Appl. No.: 09/661,397

(22) Filed: Sep. 13, 2000

(30) Foreign Application Priority Data

Sep. 14, 1999 (JP) ..... 11-259777

(51) Int. Cl.[7] ..... B41J 35/28; B41J 2/315; B41J 11/26

(52) U.S. Cl. ..... 400/207; 400/120.16; 400/613; 400/615

(58) Field of Search ..... 400/615.2, 613, 400/204, 207, 120.16, 615

(56) References Cited

U.S. PATENT DOCUMENTS

| | | | | |
|---|---|---|---|---|
| 4,944,619 A | | 7/1990 | Suzuki et al. | |
| 4,986,679 A | | 1/1991 | Kawamura | |
| 5,374,132 A | | 12/1994 | Kimura | |
| 5,536,092 A | | 7/1996 | Yamaguchi | |
| 5,653,542 A | * | 8/1997 | Sugimoto et al. | 400/248 |
| 5,752,777 A | * | 5/1998 | Nunokawa et al. | 400/208 |
| 5,813,773 A | * | 9/1998 | Kawai | 400/207 |
| 5,997,129 A | | 12/1999 | Matsuhashi | |
| 6,007,263 A | * | 12/1999 | Imai et al. | 400/693 |
| 6,042,280 A | * | 3/2000 | Yamaguchi et al. | 400/120.16 |
| 6,145,561 A | * | 11/2000 | Watanabe et al. | 400/621 |
| 6,196,740 B1 | * | 3/2001 | Yamaguchi et al. | 400/615.2 |

FOREIGN PATENT DOCUMENTS

JP 8118738 * 5/1996

OTHER PUBLICATIONS

Brother Service Manual, Model: PT–2500PC "Mechanisms & Electronics", 1998.
Brother Service Manual, Model PT–9200PC "Mechanisms & Electronics", 1998.
P–touch 2500 pc "Quick Reference" (Date: Unknown).
P–touch PRO pc "Qiuck Reference" (Date: Unknown).
P–touch 2500 pc Computer Label Printer, 1999.
P–touch PRO PC "Professional Computer Label Printer", 1998.

* cited by examiner

*Primary Examiner*—Daniel J. Colilla
*Assistant Examiner*—Marvin P Crenshaw
(74) *Attorney, Agent, or Firm*—Oliff & Berridge, PLC

(57) ABSTRACT

A cassette accommodating portion having an upper open structure is provided on a rear side of a body case in a label tape forming device. A first pressing member and a second pressing member protrude downward from right and left of the inner surface of a cover having a center of rotation at the rear side of the body case. A fin-shaped first detector portion and a fin-shaped second detector portion are formed on right and left of the rear side of a cassette to be installed. When the cassette is installed in the cassette accommodating portion in a proper posture and the cover is closed, the first detector portion and the second detector portion are pressed by the first pressing member and the second pressing member, respectively, and thus the cover is completely closed.

27 Claims, 27 Drawing Sheets

CASSETTE AND DETECTING DEVICE FOR INSTALLATION THEREOF

BACKGROUND OF THE INVENTION

1. Field of the Invention

The invention relates to a label tape forming device that prints indicia onto a tape-shaped recording medium, and to a cassette and a cassette installation detecting device capable of detecting whether the cassette is installed in a proper position in the label tape forming device.

2. Description of the Related Art

As disclosed in Japanese Laid-Open Patent Publication No. 7-68814, Japanese Laid-Open Patent Publication No. 7-314866, and Japanese Laid-Open Patent Publication No. 8-118738, this type of conventional label tape forming device generally includes a cassette accommodating portion having an upper open structure in which a cassette that accommodates a recording medium, such as a printing tape (film tape), and an ink ribbon in a wound state can be accommodated. A plurality of switch holes as a detector surface are formed in a corner of one side of the cassette surface so that a type of the cassette can be detected. That is, the switch holes are arranged in a predetermined pattern in accordance with a combination of a width of the printing tape, a type (recept type: a normal posture character image is printed, lamination type: a mirror posture character image is printed), and a color of an ink ribbon. A plurality of ON and OFF switches as a detecting portion upwardly protrude from the cassette accommodating portion at a position corresponding to the switch holes. When the tip of an ON and OFF switch is inserted in to the switch hole, an OFF signal is produced. On the other hand, when the tip of the ON and OFF switch is pressed by the cassette because no switch hole exists, an ON signal is produced. Accordingly, the type of the cassette can be detected based on the combination of the ON and OFF signals.

However, in the conventional cassette installation detecting device, a signal to announce the completion of the cassette installation may be produced if the detector surface coincides with the detector portion by accident, even when the cassette is tilted to the right/left or up/down, because the detector surface is provided only in the corner of one side of the cassette surface. When printing is performed onto the printing tape under such a condition, indicia is printed deviated from the proper position where the indicia is supposed to be printed or the ink ribbon and the printing tape are transported deviated from the proper path. If the installation is improper, the ink ribbon and the printing tape may be damaged or cut off.

SUMMARY OF THE INVENTION

According to the invention, a cassette installation detecting device for a label tape printing device is provided which can immediately and precisely detect abnormalities when a cassette is improperly installed in a cassette accommodating portion, and a cassette to be used in the label tape forming device is provided.

According to an exemplary embodiment of the invention, a cassette installation detecting device used in a printer that performs printing on a recording medium accommodated in a cassette at a printing portion includes a cassette accommodating portion having an accommodating surface that accommodates the cassette accommodating at least one of the recording medium and an ink ribbon thereof; a cover that moves between a position where the cover faces the cassette accommodating surface and covers the cassette accommodating portion and a position where the cover uncovers the cassette accommodating portion; a plurality of detector positions that are provided at positions apart from each other within the cassette accommodating portion; and detecting members that are formed on the cover and are positioned in respective detector positions when the cover covers the cassette accommodating portion.

According to another exemplary embodiment of the invention, the cassette installation detecting device used in the printer may further include a detecting portion that detects a first detector portion formed on one side of the cassette installed in the cassette accommodating portion, from an opposed side of the side to be covered with the cover in the cassette. The detecting members include a first pressing member and a second pressing member. The first pressing member presses the first detector portion of the cassette installed in the cassette accommodating portion toward the accommodating surface. The second pressing member presses a second detector portion formed on the other side apart from the first detector portion toward the accommodating surface.

In a conventional cassette installation detecting device, when only one detecting member is provided on the cover, improper installation of the cassette can not be detected. However, in the invention, when the cassette is pressed by pressing members at one or more positions in the cassette accommodating portion, the cassette condition can be easily and precisely detected and whether the cassette is installed in the proper position in the proper posture can be detected.

Further, in the cassette installation detecting device used in the printer, the first detector portion indicates a type of the cassette. Therefore, the type of the installed cassette can be detected at the detecting portion in the cassette accommodating portion, so that the cassette installation can be detected in more detail.

According to another exemplary embodiment of the invention, the cover is not closed at the position where the cover completely covers the cassette because of an interference with at least one of the first pressing member and the second member against the cassette when the cassette is not installed in a proper position in the cassette accommodating portion.

Therefore, only by observing the condition of the cover, a user can easily determine whether the cassette is installed in the proper posture. Accordingly, printing can be prevented from performing under the condition that the cassette is installed in the improper posture.

According to another exemplary embodiment of the invention, a cassette that can be installed in a printer having a cassette accommodating portion and a cover movable between a position where the cover covers the accommodating position and a position where the cover uncovers the cassette accommodating portion includes a first detector portion, a second detector portion, and at least one of a recording medium and an ink ribbon. The first detector portion and the second detector portion are formed at the same height in the width direction of the recording medium or the ink ribbon regardless of the width of the recording medium or the ink ribbon.

Therefore, the cassette condition can be easily detected when the cassette is replaced with a cassette accommodating the different width of the recording medium or the ink ribbon.

According to another exemplary embodiment of the invention, in the cassette, the first detector portion and the second detector portion are formed to position on the side adjacent to a center of rotation of the cover when the cassette is installed in the accommodating portion.

With this arrangement, the incorrect installation, such that the cassette is installed in the incorrect direction, can be detected only by confirming the direction of the first detector portion and the second detector portion. Accordingly, the incorrect installation can be prevented.

BRIEF DESCRIPTION OF THE DRAWINGS

Various exemplary embodiments of the invention will be described in detail with reference to the following figures wherein.

DETAILED DESCRIPTION OF EXEMPLARY EMBODIMENTS

Various exemplary embodiments of the invention will be described below.

Figure 1:
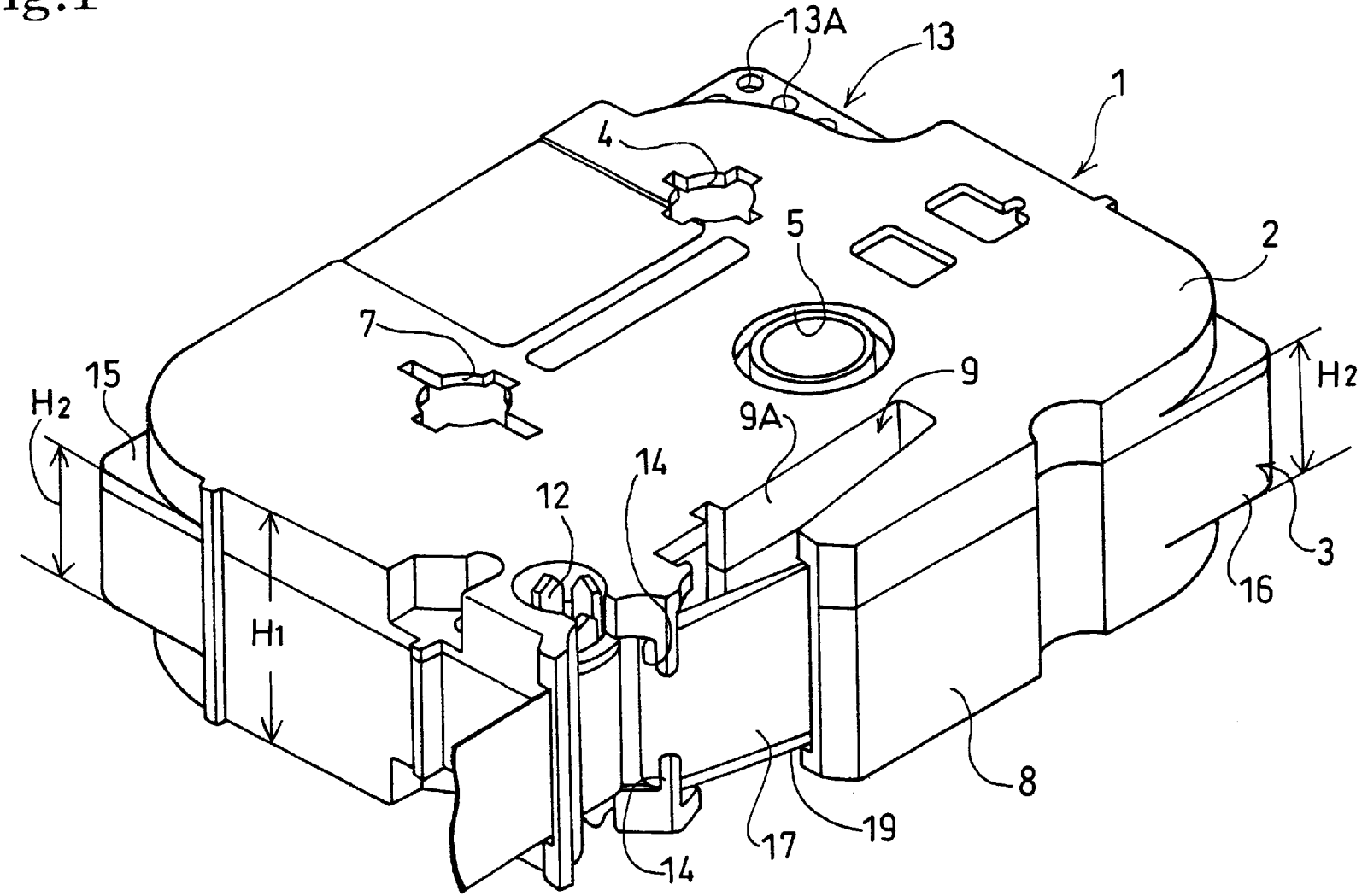
FIG. 1 is a perspective view of a cassette.
Figure 2A:
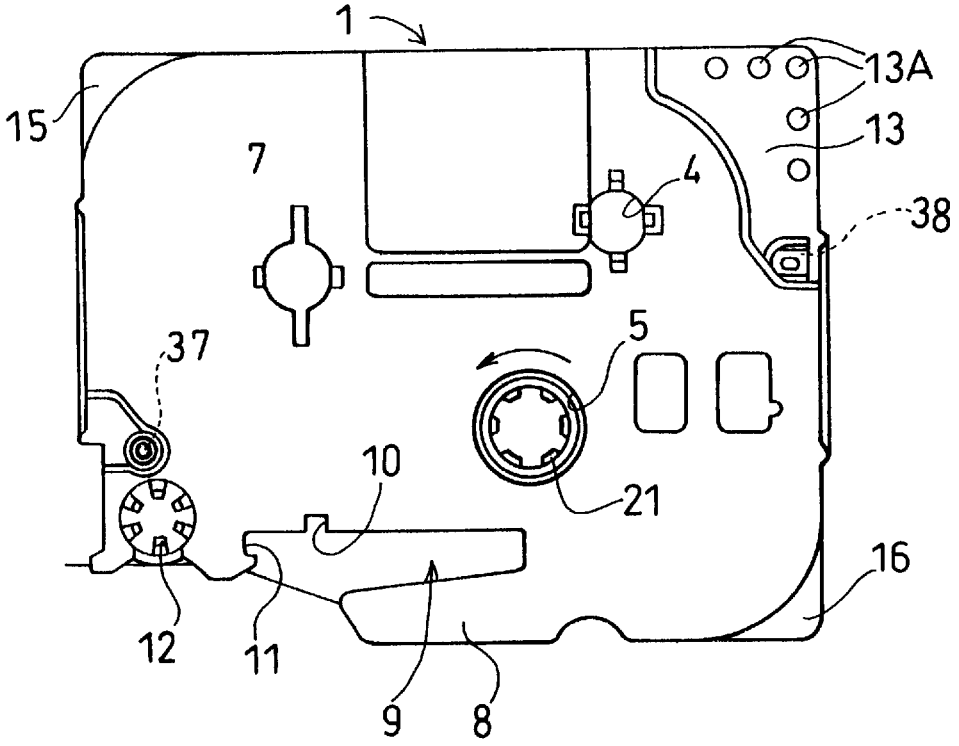
FIG. 2A is a plan view of the cassette of FIG. 1.
Figure 2B:
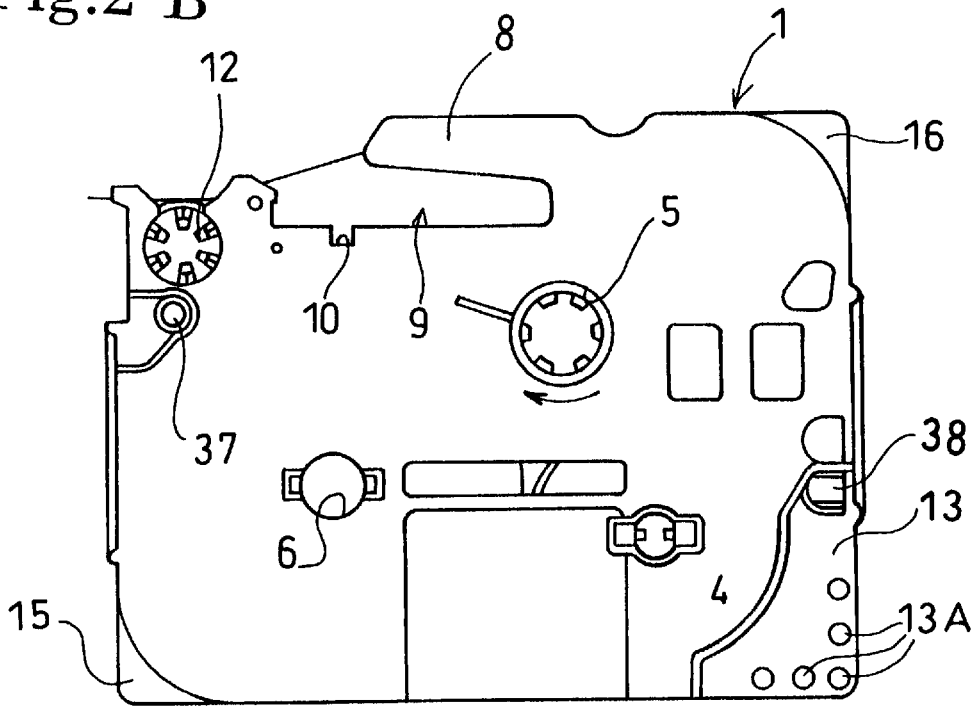
FIG. 2B is a bottom view of the cassette of FIG. 1.
Figure 3:
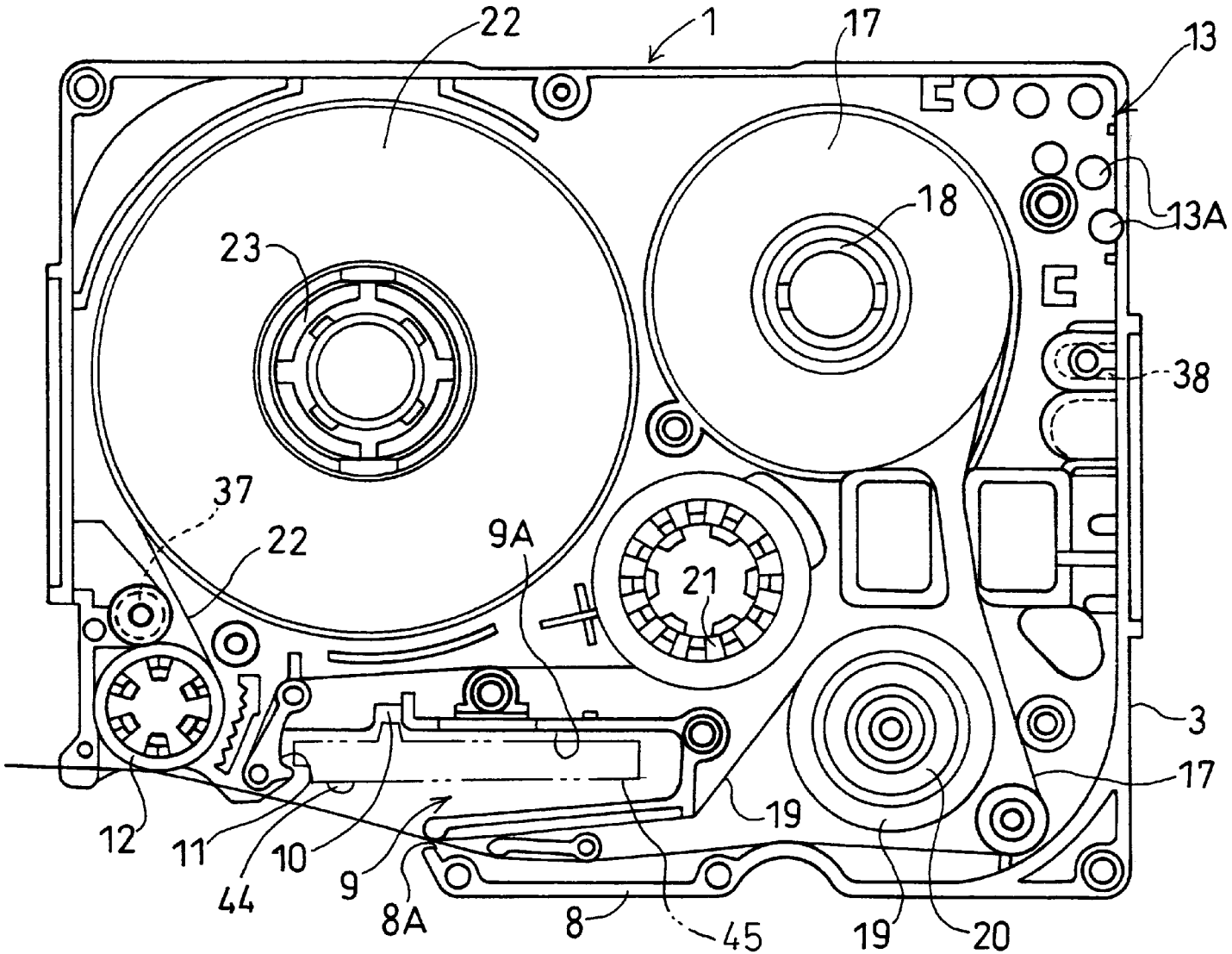
FIG. 3 is a plan view of the cassette of FIG. 1, shown with an upper case is removed.
Figure 4:
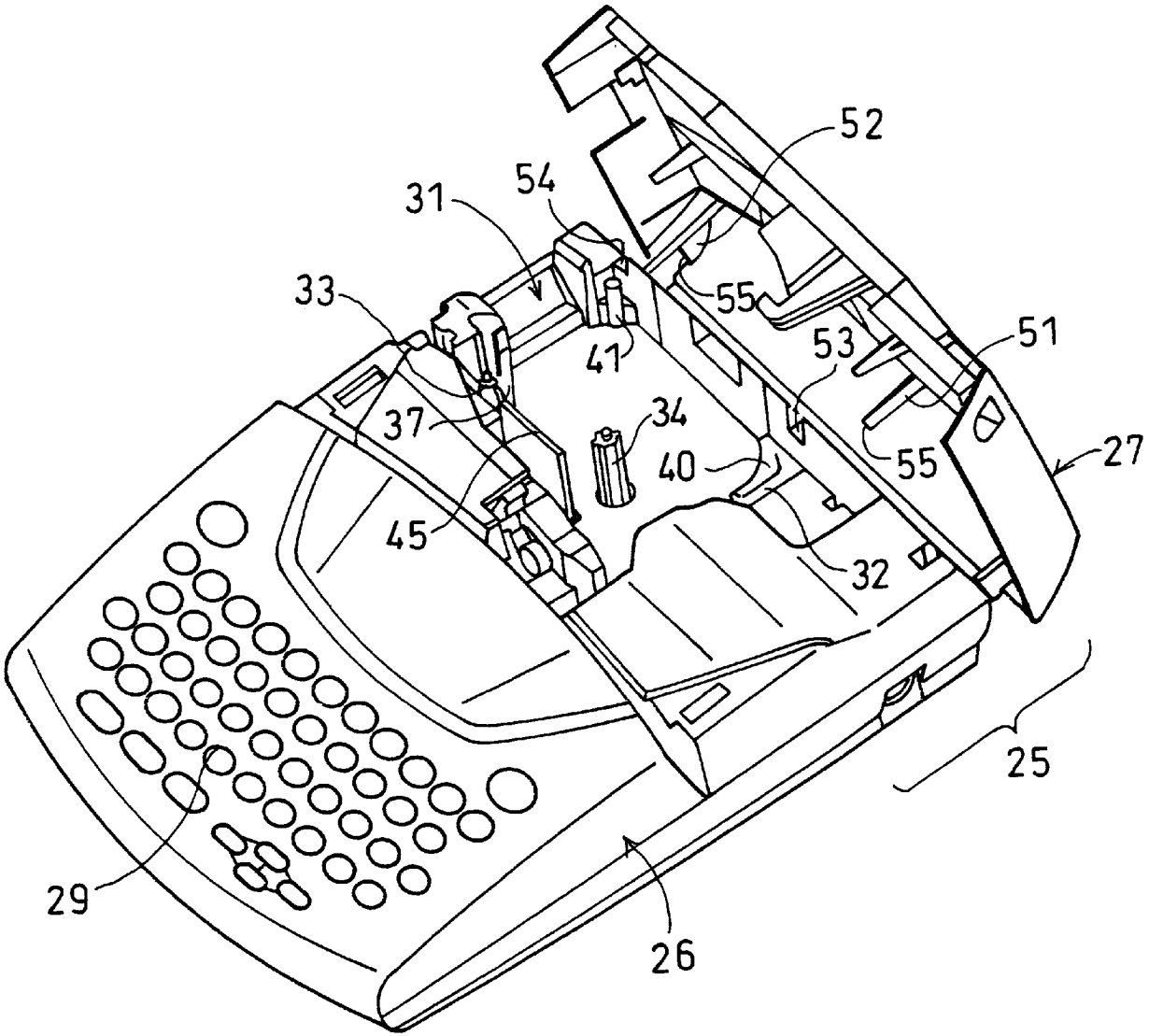
FIG. 4 is a perspective view of a label tape forming device when a cover is opened and no cassette is installed in a cassette accommodating portion of a first embodiment.
Figure 5:
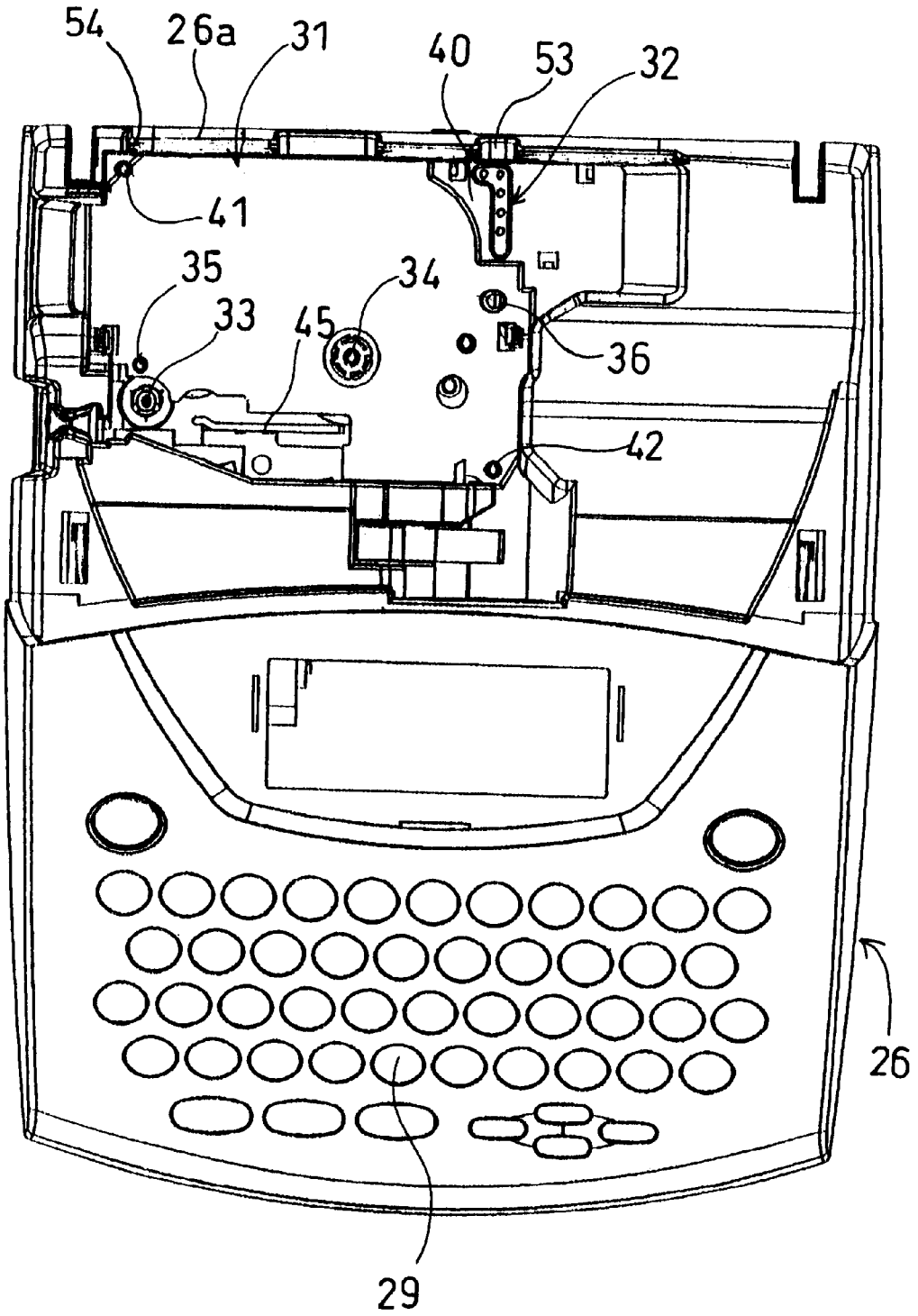
FIG.5 is a plan view of a body case when no cassette is installed in the cassette accommodating portion of the first embodiment.
Figure 6:
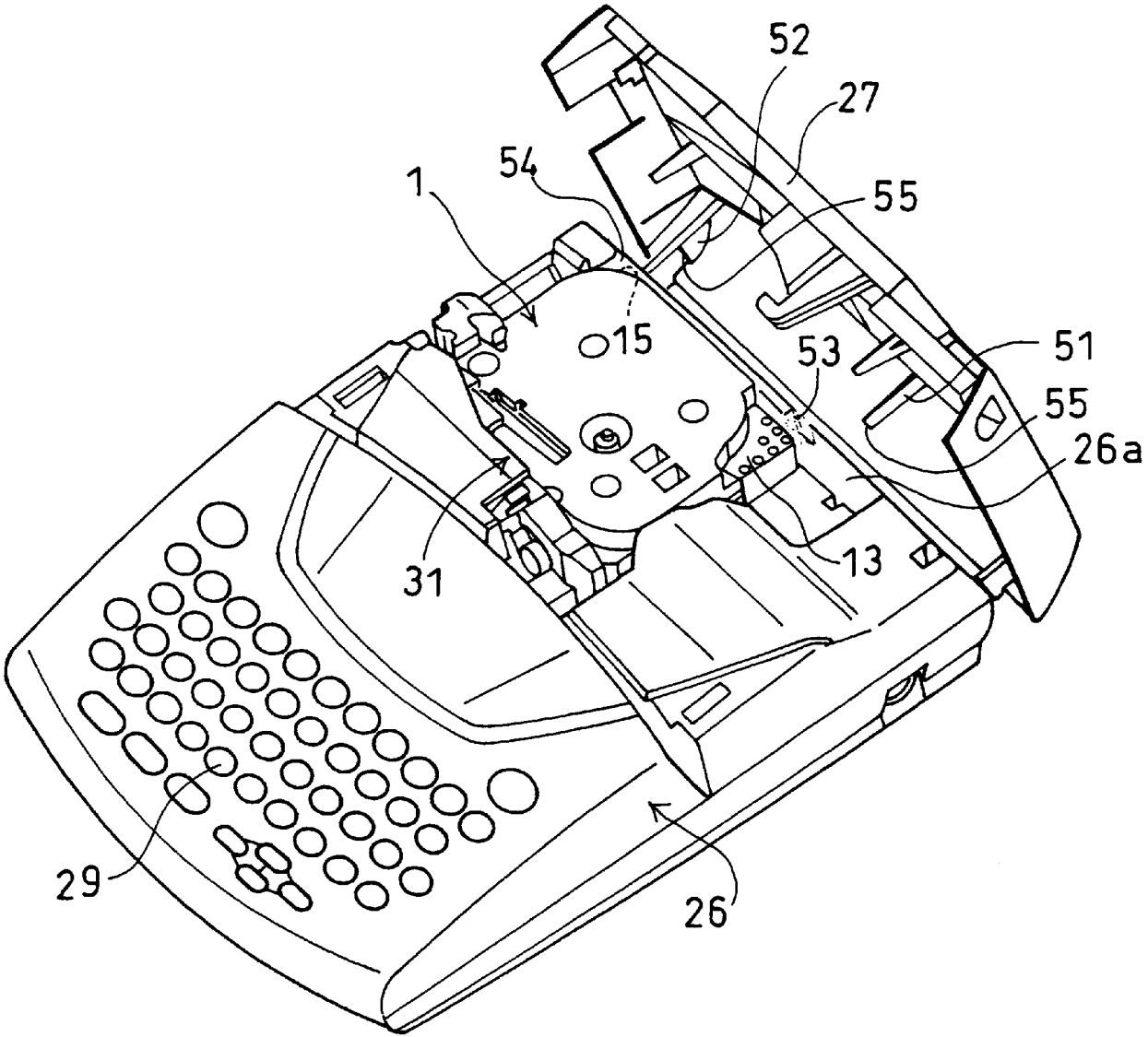
FIG. 6 is a perspective view of the label tape forming device when the cover is opened and the cassette is installed in the cassette accommodating portion.

A main structure of a cassette 1 will be described with reference to FIGS. 1–3. As shown in FIG. 1, the cassette 1 includes an upper case 2 and a lower case 3. Support holes 4, 5, and 7 are formed in the cassette 1. The support hole 4 rotatably supports a tape spool 18 around which a film tape 17, as a tape-shaped recording medium described later, is wound. The support hole 5 supports a ribbon take-up spool 21. When characters and the like are printed onto the film tape 17 using a thermal head 44, the ribbon take-up spool 21 draws out and winds up an ink ribbon 19 from a ribbon spool 20. The support hole 7 rotatably supports a tape spool 23 around which a double-sided adhesive tape 22 described later is wound with a release sheet of the double-sided adhesive tape 22 facing outwards. Support holes 4, 5, and 7 are similarly formed in the lower case 3, facing each support hole 4, 5, and 7 in the upper case 2, respectively.

An arm portion 8 is provided on the front side of the tape cassette 1, that is, the lower side in FIG. 1. The arm portion 8 forms a guiding portion that guides the film tape 17 drawn out from the tape spool 18 and the ink ribbon 19 drawn out from the ribbon spool 20 and discharges the film tape 17 and the ink ribbon 19 from an opening 8A. A head mounting recess 9 is provided at the rear of the arm portion 8. The head mounting recess 9 accepts a thermal head 44 of a tape printing device when the cassette 1 is installed. In a wall portion 9A of the head mounting recess 9 confronting the arm portion 8, a first engagement portion 10 is formed internally projecting toward the rear of the cassette 1. In the left side wall of the head mounting recess 9, a second engagement portion 11 is formed projecting perpendicular to the first engagement portion 10 (in a direction along the wall portion 9A). As described later, the first engagement portion 10 and the second engagement portion 11 are engaged with each protrusion (not shown) formed on a head holder 45 supporting the thermal head 44. Accordingly, the head holder 45 can be inserted into the head mounting recess 9 without interfering with the ink ribbon 19 and the film tape 17.

A tape feed roller 12 is rotatably supported by a support hole at a position downstream from the head mounting recess 9 with respect to a feed direction of the ink ribbon 19 and the film tape 17. The tape feed roller 12 draws the film tape 17 and the double-sided adhesive tape 22 from the tape spool 18 and the tape spool 23, respectively, in cooperation with a sub roller (not shown) pressed against the tape feed roller 12 from the opposite side. Further, the tape feed roller 12 feeds the double-sided adhesive tape 22 and the film tape 17, on which characters and the like are printed by the thermal head 44 via the ink ribbon 19, together such that they are adhered to each other.

A pair of upper and lower regulating members 14, 14 are provided near the tape feed roller 12. Each regulating member 14, 14 guides the film tape 17, on which characters and the like have been printed, to regulate its movement in the width direction of the film tape 17 and to properly adhere the film tape 17 and the double-sided adhesive tape 22 without causing displacements at a position downstream from the thermal head 44.

Figure 7:
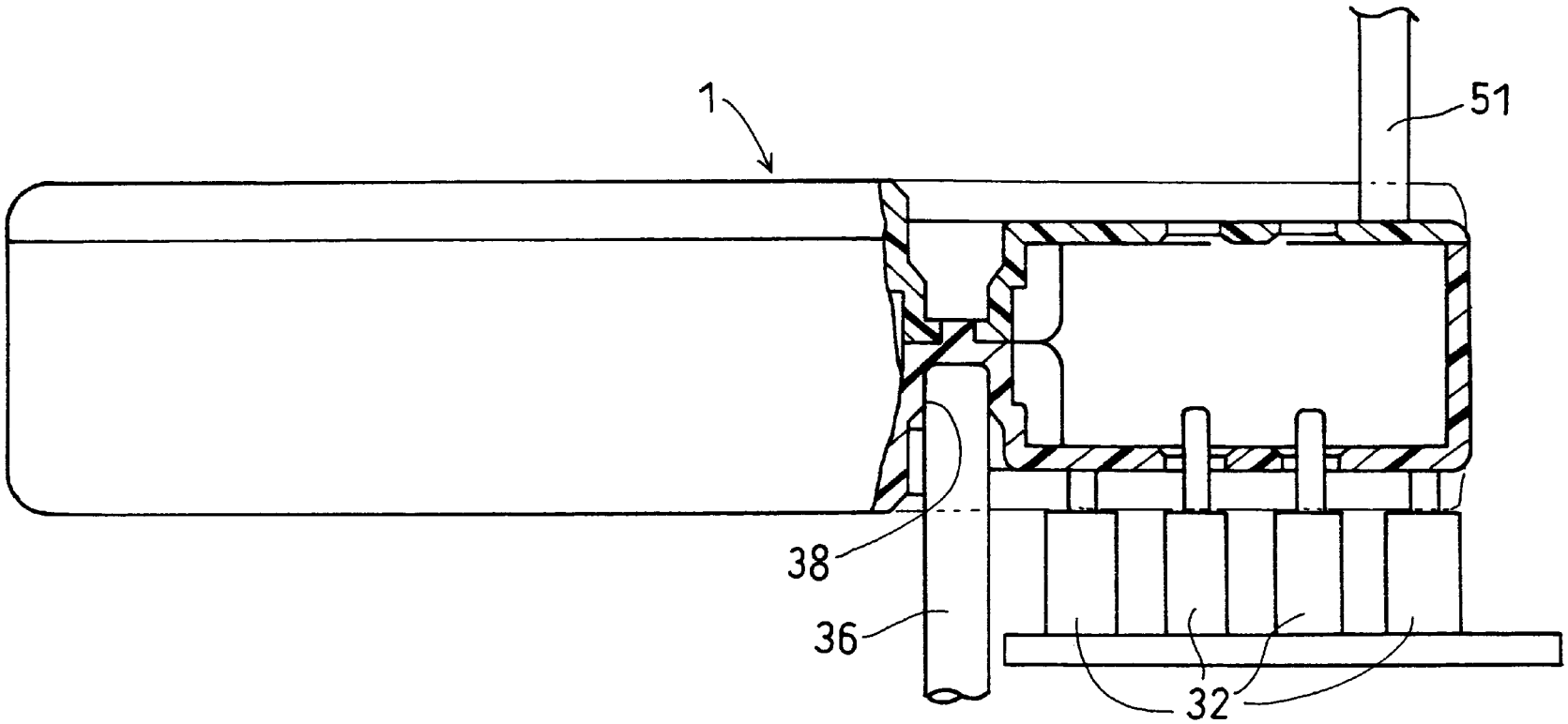
FIG. 7 is a sectional side view of a first detector portion and a detecting portion.

Fin shaped first and second detector portions 13 and 15 are provided on right and left rear edges of the cassette 1, respectively. The first and second detector portions 13, 15 protrude from substantially the middle of the cassette 1 in the width direction. In order to define the type of the cassette 1 (e.g., cassette information including the width of the film tape 17 and the color of ink coating the ink ribbon 19), a plurality of switch holes 13A forming a predetermined pattern are vertically formed in the first detector portion 13 provided on the right rear edge of the cassette 1. The pattern formed from the switch holes 13A depends on the type of the cassette 1. The pattern formed from the switch holes 13A is detected based on the combination of ON and OFF signals produced by a plurality of detecting switches 32 (see FIG. 7) protruding from a detecting portion 40 provided in the cassette accommodating portion 31 of the label tape forming device 25. A pin hole 38, into which a positioning pin 36 is inserted, is formed in the first detector portion 13.

Next, a structure of the label tape forming device 25 will be described with reference to FIGS. 4 through 10. A cover 27 is attached to a rear end of the body case 26 in the label tape forming device 25 so that the cover 27 can open and close by pivoting about a shaft 28.

A key touch panel 29 for inputting printing data and printing commands are provided on upper front of the body case 26. The cassette accommodating portion 31 having an upper open structure is provided on the rear portion of the body case 26. In the cassette accommodating portion 31, the head holder 45, a tape drive shaft 33 with an engagement rib, and a ribbon take-up drive shaft 34 with an engagement rib protrude upwardly from a bottom frame 30 made of, for example, metal. When the cassette 1 is installed in the cassette accommodating portion 31, the tape drive shaft 33 and the ribbon take-up drive shaft 34 are inserted into bores of the tape feed roller 12 and the ribbon take-up spool 21, respectively. The tape drive shaft 33 and the ribbon take-up drive shaft 34 are rotated via a drive motor (not shown) and a transmission gear train (not shown).

The cassette accommodating portion 31 is structured so that the cassette 1 accommodating the film tape 17 having various width can be suitably installed. When the width of the film tape 17 accommodated in the cassette 1 varies, the cassette thickness H1, which is the height from the bottom surface of the lower case 3 to the top surface of the upper case 2, is inevitably changed. However, the thickness H2 of each of the first detector portion 13, the second detector portion 15, and the fin-shaped protrusion 16 (see FIGS. 1 and 2A) provided on the right front edge of the cassette 1, should be formed so as to be always the same, regardless of the cassette thickness H1. For example, the cassette 1 shown in FIGS. 8 and 9, accommodates a 12 mm-wide film tape 17 and the cassette 1 shown in FIGS. 10 through 12 accommodates a 24 mm-wide film tape 17, so that the cassette thickness H1 is different therebetween. However, the thickness H2 of each of the first detector portion 13, the second detector portion 15, and the fin-shaped protrusion 16 of the cassette 1 accommodating the 12 mm-wide film tape 17 and the cassette 1 accommodating the 24 mm-wide film tape 17 is identical.

As shown in FIGS. 4, 5, and 9–12, two positioning pins 35, 36 protruding upward from the bottom frame 30 are inserted into the pin holes 37, 38, recessed in the cassette 1. Further, the tips of the positioning pins 35, 36 contact the bottom surfaces of the pin holes 37, 38 so that the cassette 1 can be seated in the proper position in the cassette accommodating portion 31.

Further, the detecting portion 40, where the detecting switches 32 are arranged thereon at the right rear of the cassette accommodating portion 31, is opposed to the bottom surface of the first detector portion 13 of the cassette 1. A support pin 41 protruding upward from the left rear of the cassette accommodating portion 31 contacts the bottom surface of the second detector portion 15. A support pin 42 protruding upward from the right front of the cassette accommodating portion 31 contacts the bottom surface of the protrusion 16 (see FIGS. 9 through 11).

Therefore, the positioning pins 35, 36 and the support pins 41, 42, as a support portion, are formed in a predetermined height, so that the cassette 1 is supported in a substantially horizontal posture and the center of the film tape 17 in the width direction is always positioned at the same height regardless of the width of the cassette 1.

Next, a structure of a cassette installation detecting device that can detect whether the cassette 1 is installed in the cassette accommodating portion 31 in a proper posture will be described. The cover 27 can cover and uncover the cassette accommodating portion 31 at the upper portion of the cassette accommodating portion 31. As shown in FIGS. 4 and 8–14, on the inner surface of the cover 27, a pair of pressing members, including, a first pressing member 51 and a second pressing member 52, protrude downward from right and left of the side near the shaft 28 which is the center of the rotation of the cover 27. The first pressing member 51 and the second pressing member 52 can be integrally formed with the cover 27 made from, for example, synthetic resin. The first pressing member 51 is disposed at the position where the first pressing member 51 can press downward the upper surface of the first detector portion 13 of the cassette 1 installed in the cassette accommodating portion 31. The second pressing member 52 is disposed at the position where the second pressing member 52 can press downward the upper surface of the second detector portion 15 of the cassette 1. In this embodiment, the first pressing member 51 and the second pressing member 52 have a flat plate shape with a stiffening rib in cross section. A pressing portion 55 having a flat surface is formed at each lower end surface of the first pressing member 51 and the second pressing member 52.

The first pressing member 51 and the second pressing member 52 extend downward and are disposed at the side near the center of the rotation of the cover 27. Therefore, cutaway portions 53, 54 (see FIGS. 5 and 6), through which the first pressing member 51 and the second pressing member 52 pass as the cover 27 is rotated, are formed in a rear wall 26*a*. Accordingly, the first pressing member 51 and the second pressing member 52 do not make contact with the rear wall 26*a* of the body case 26 when the cover 27 is lifted open. For example, the cassette 1 accommodating the 12 mm-wide film tape 17 is installed in the proper position of the cassette accommodating portion 31 in the proper posture. The proper position is where the positioning pins 35, 36 are inserted into the pin holes 37, 38, respectively, in the direction parallel to the depth of the pin holes 37, 38, for positioning the cassette 1, where the tips of the positioning pins 35, 36 contact the bottom surface of the pin holes 37, 38, and where the installed cassette 1 is supported in the horizontal posture (the bottom surface of the second detector portion 15 and the protrusion 16 of the cassette 1 contact the tip of the support pins 41, 42 as a support portion, respectively).

Figure 8:
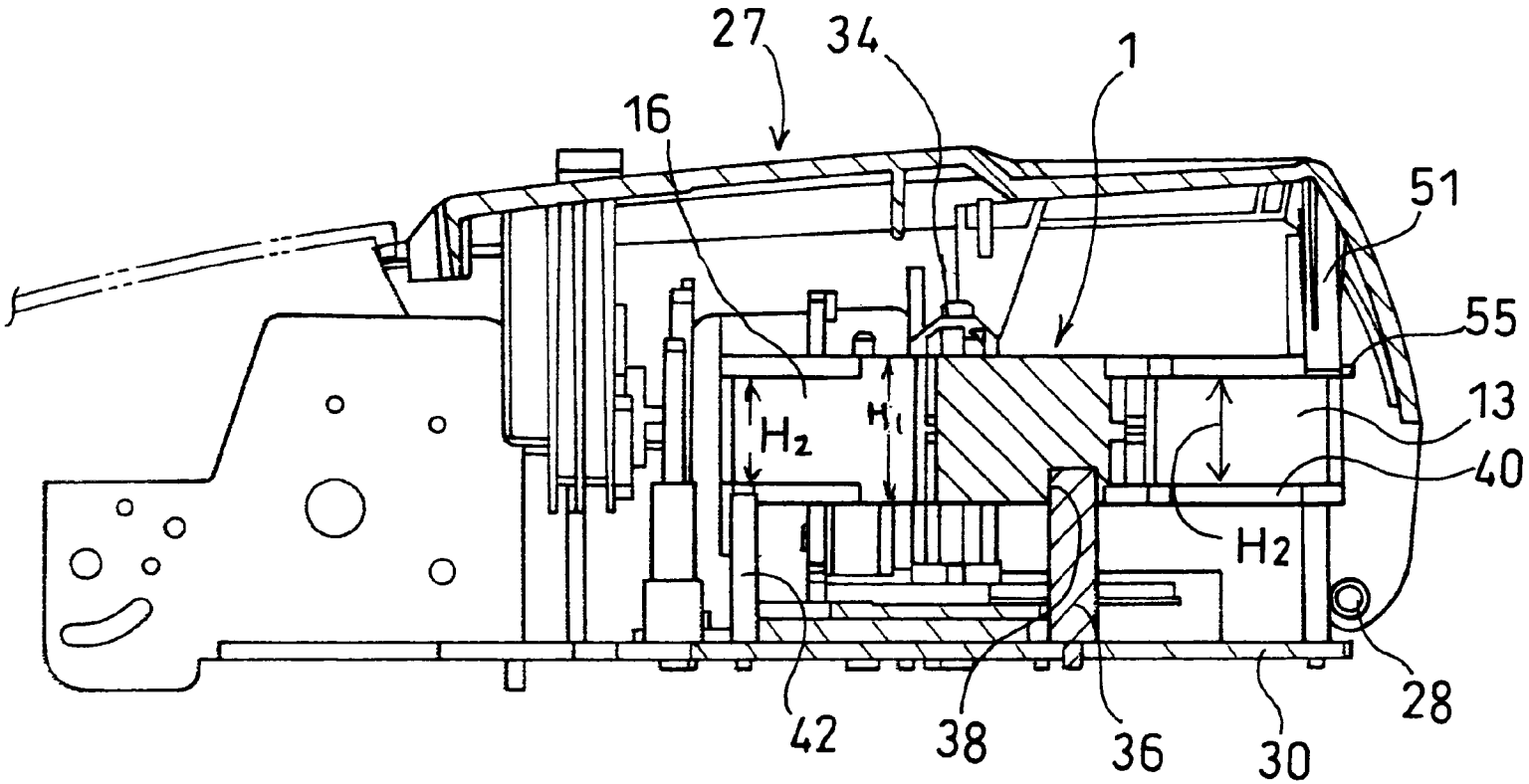
FIG. 8 is a sectional right-side view of the label tape forming device when the cassette accommodating a 12 mm-wide film tape thereof is installed in the cassette accommodating portion in a proper posture.
Figure 9:
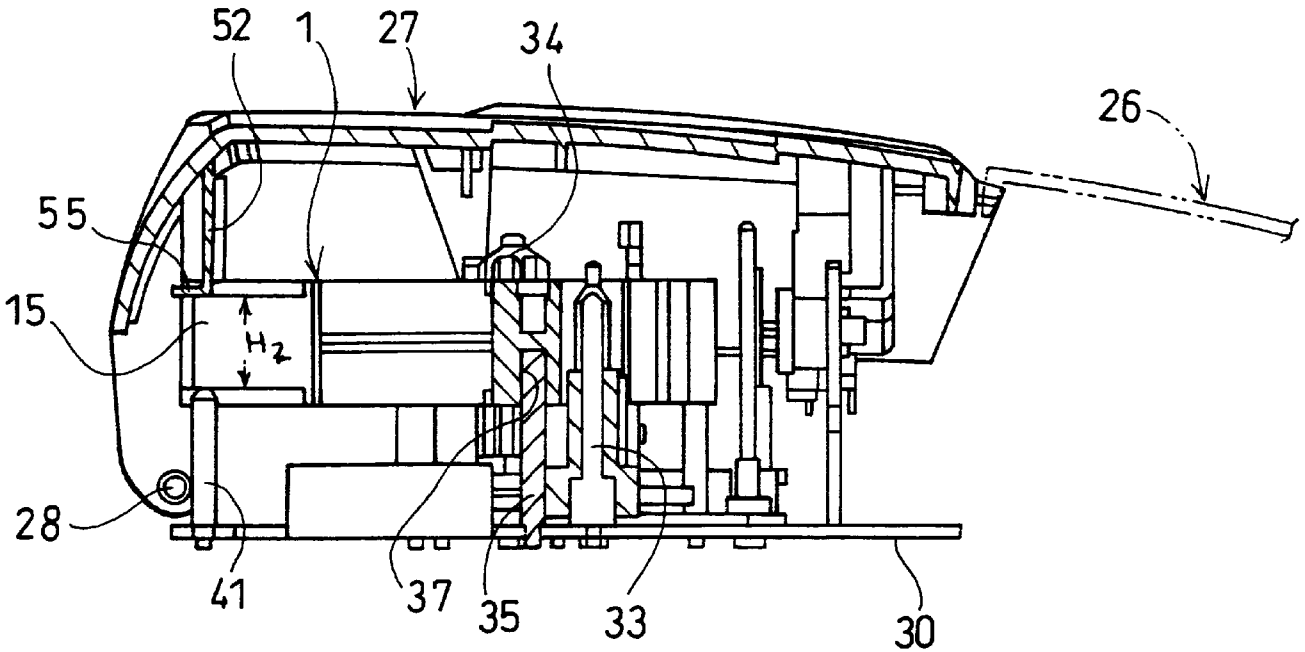
FIG. 9 is a sectional left-side view of the label tape forming device when the cassette accommodating the 12 mm-wide film tape thereof is installed in the cassette accommodating portion in the proper posture.
Figure 14:
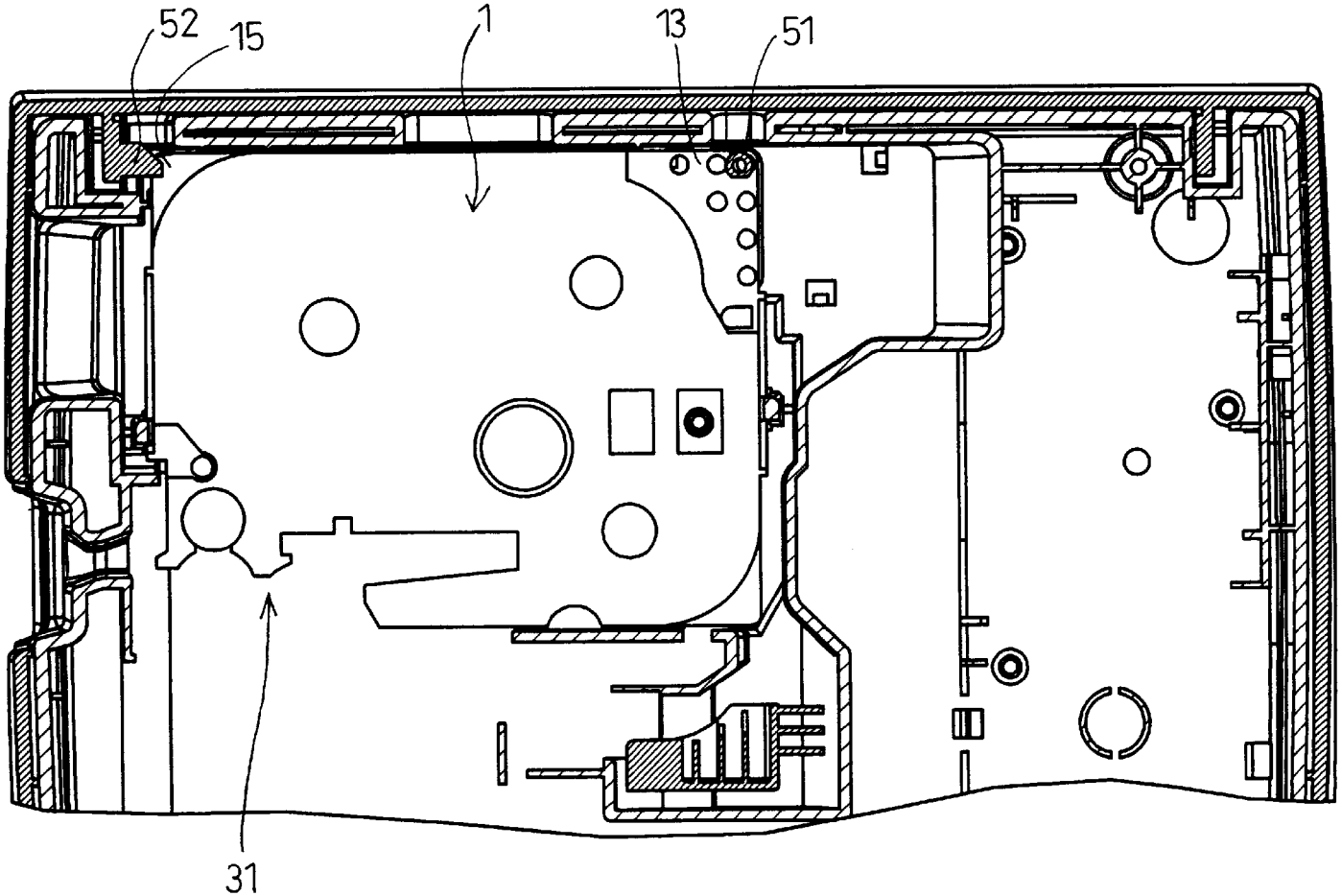
FIG. 14 is a plan view of the body case when the cassette is installed in the cassette accommodating portion.
Figure 15:
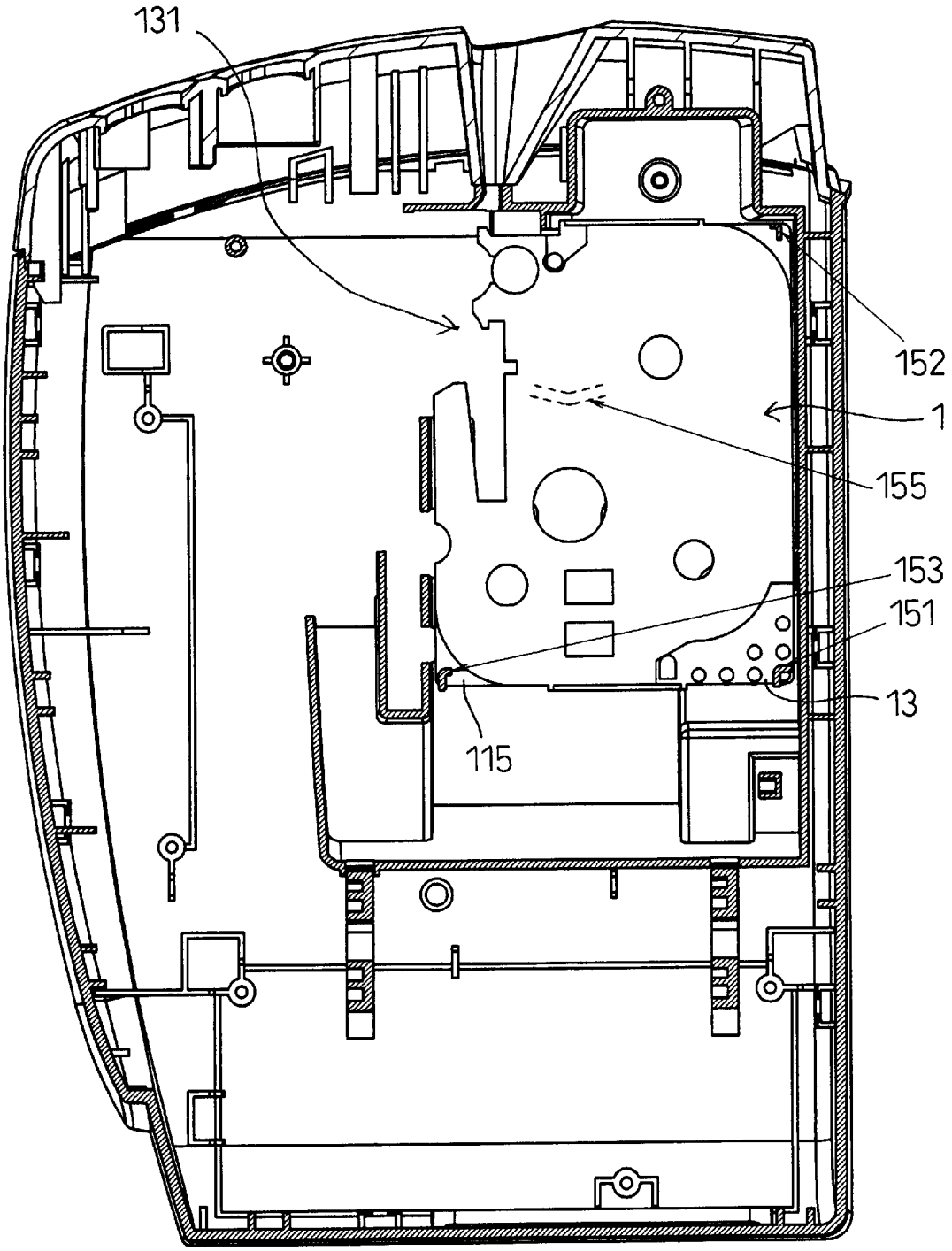
FIG. 15 is a plan view of a body case when the cassette is installed in a cassette accommodating portion of another exemplary embodiment.
Figure 16:
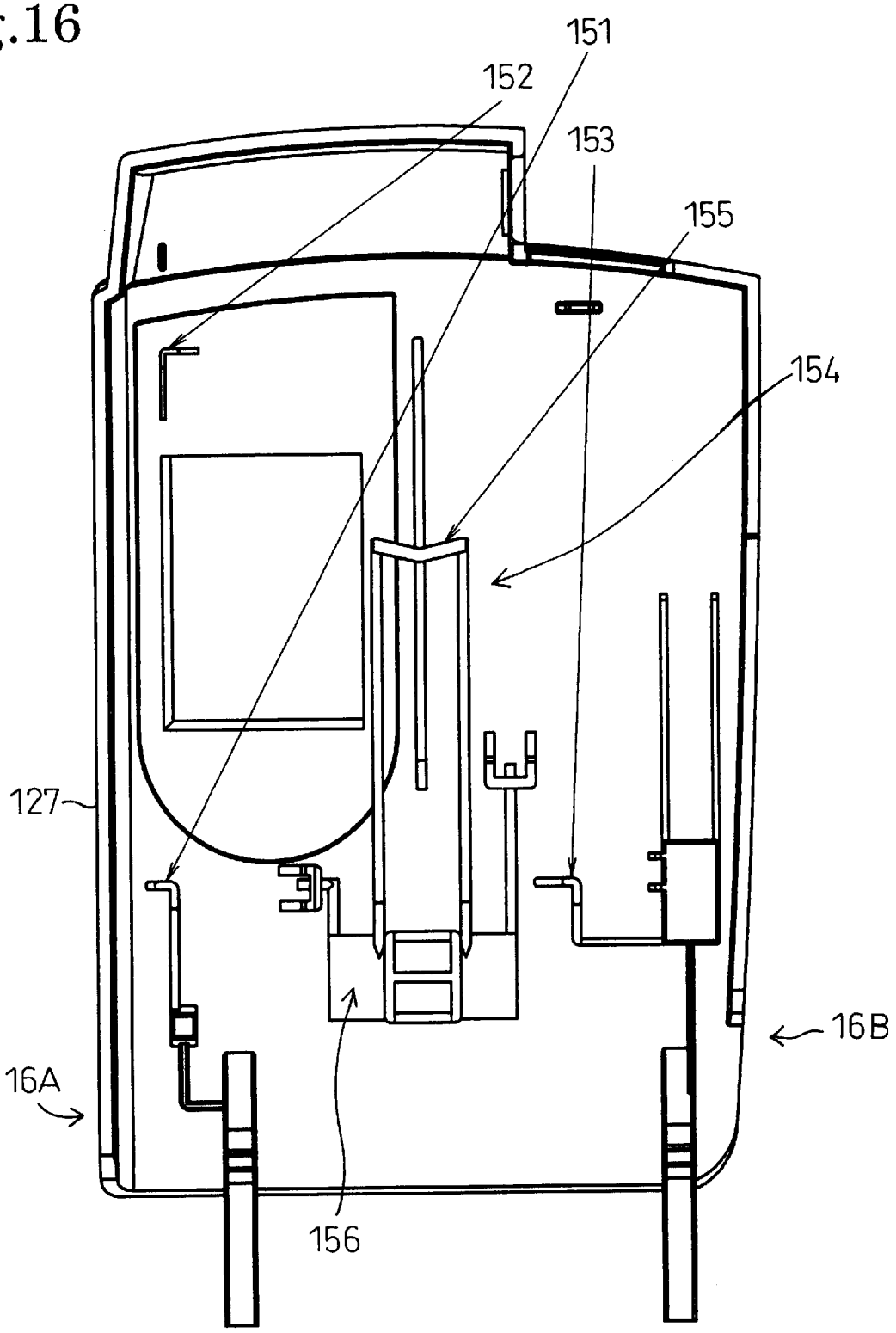
FIG. 16 is a plan view showing the inside of a cover.
Figure 17:
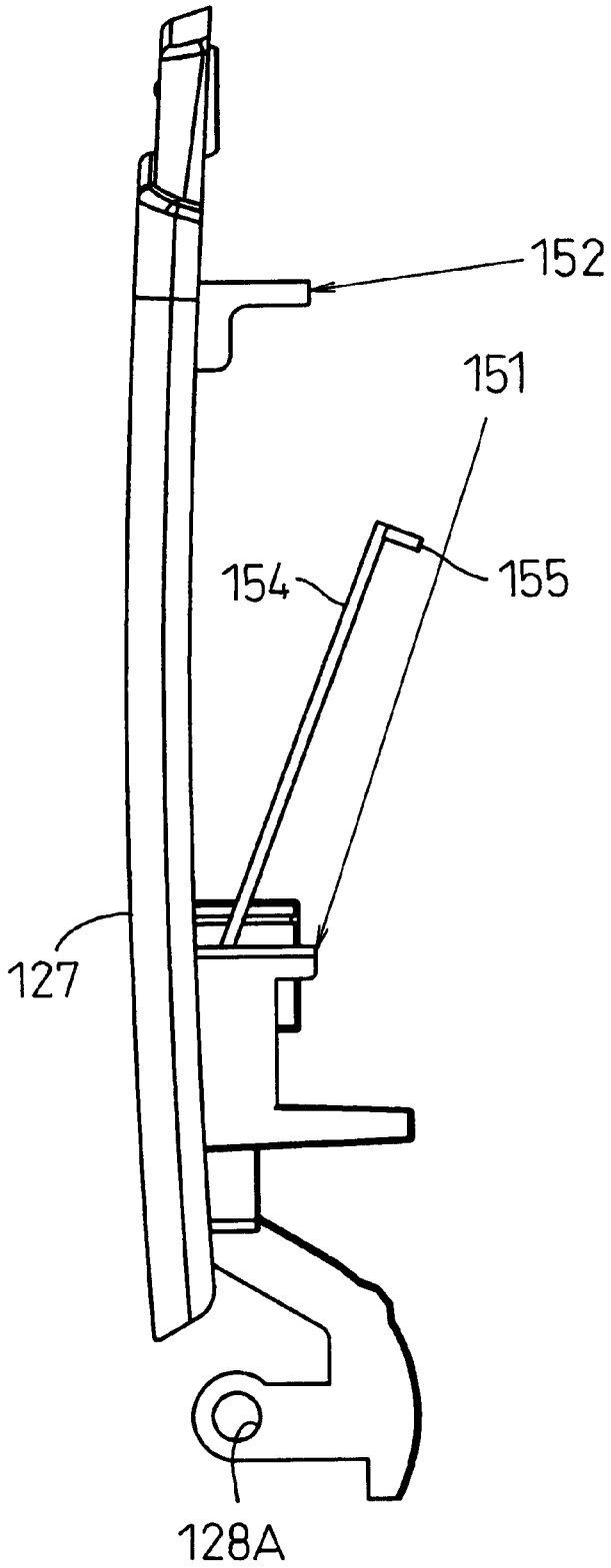
FIG. 17 is a side view of the cover shown in FIG. 16 when viewed from a direction pointed by an arrow 16A.
Figure 18:
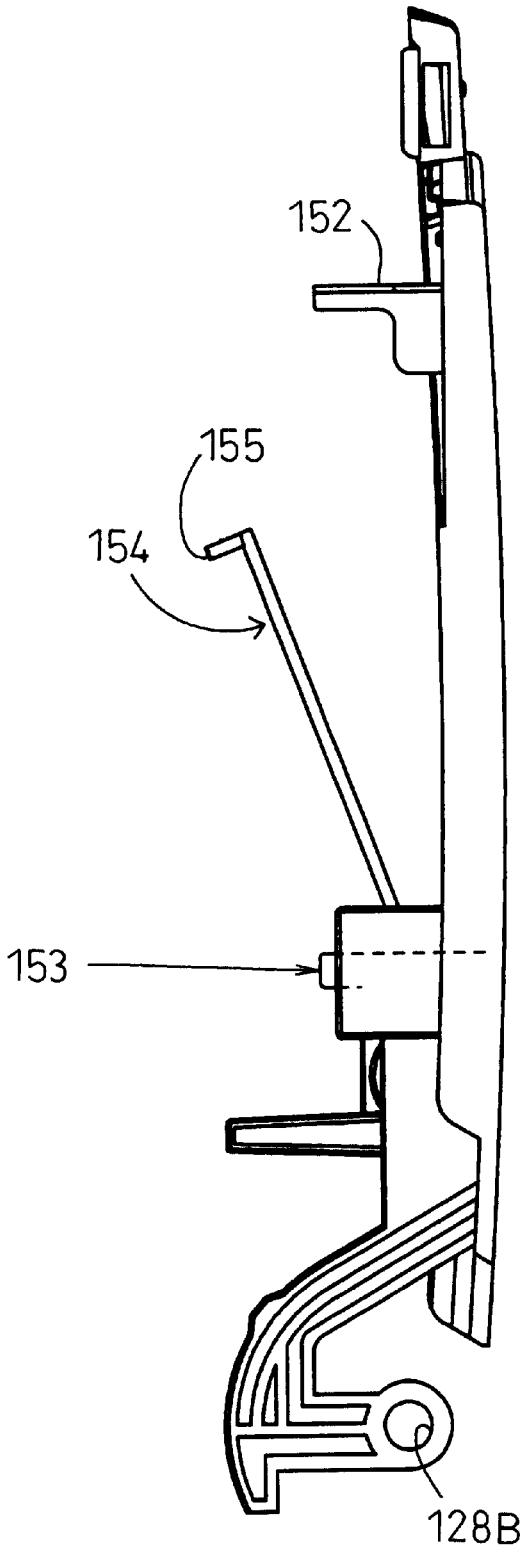
FIG. 18 is a side view of the cover shown in FIG. 19 when viewed from a direction pointed by an arrow 16B.
Figure 19:
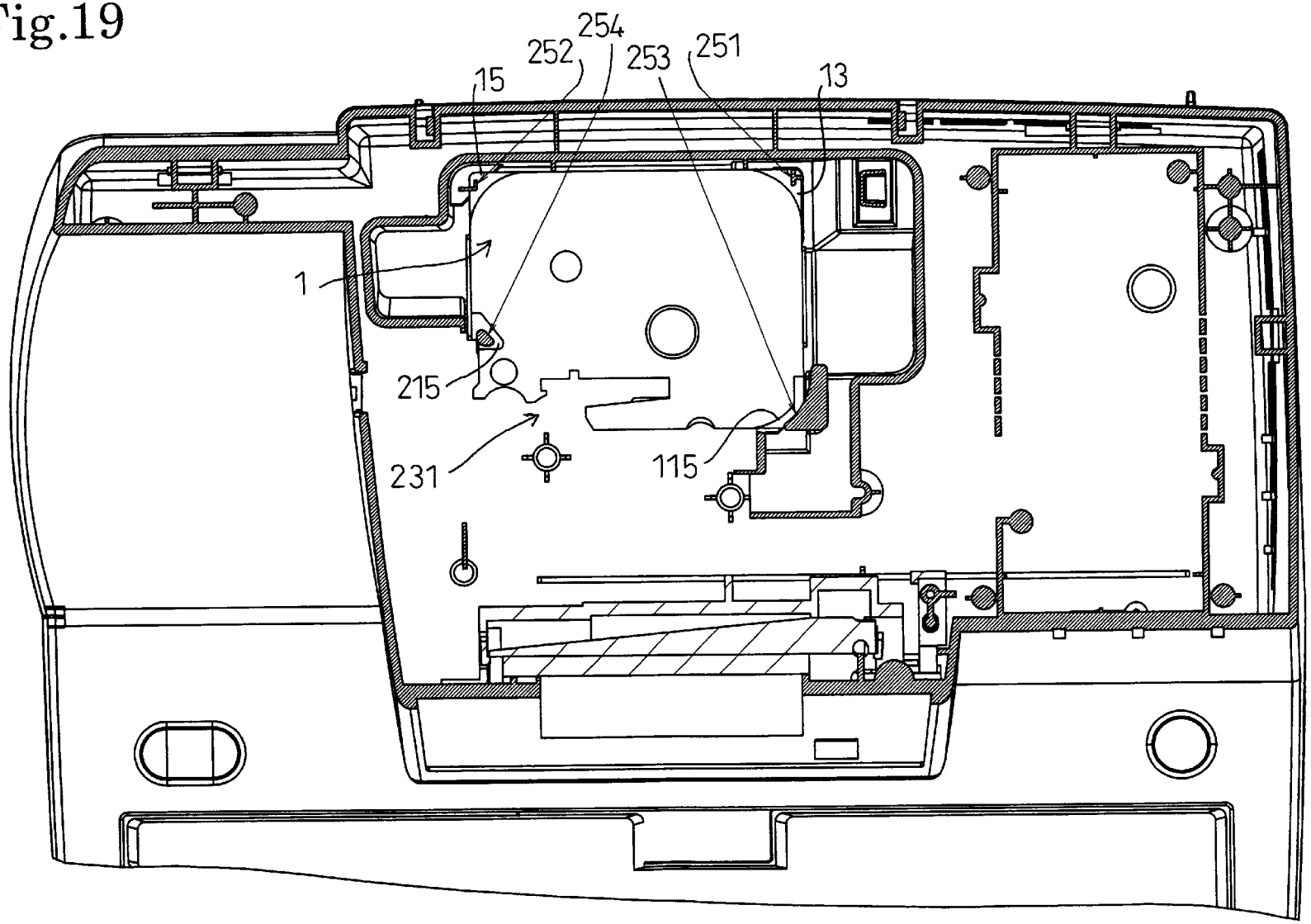
FIG. 19 is a plan view of a body case when the cassette is installed in a cassette accommodating portion of another exemplary embodiment.
Figure 20:
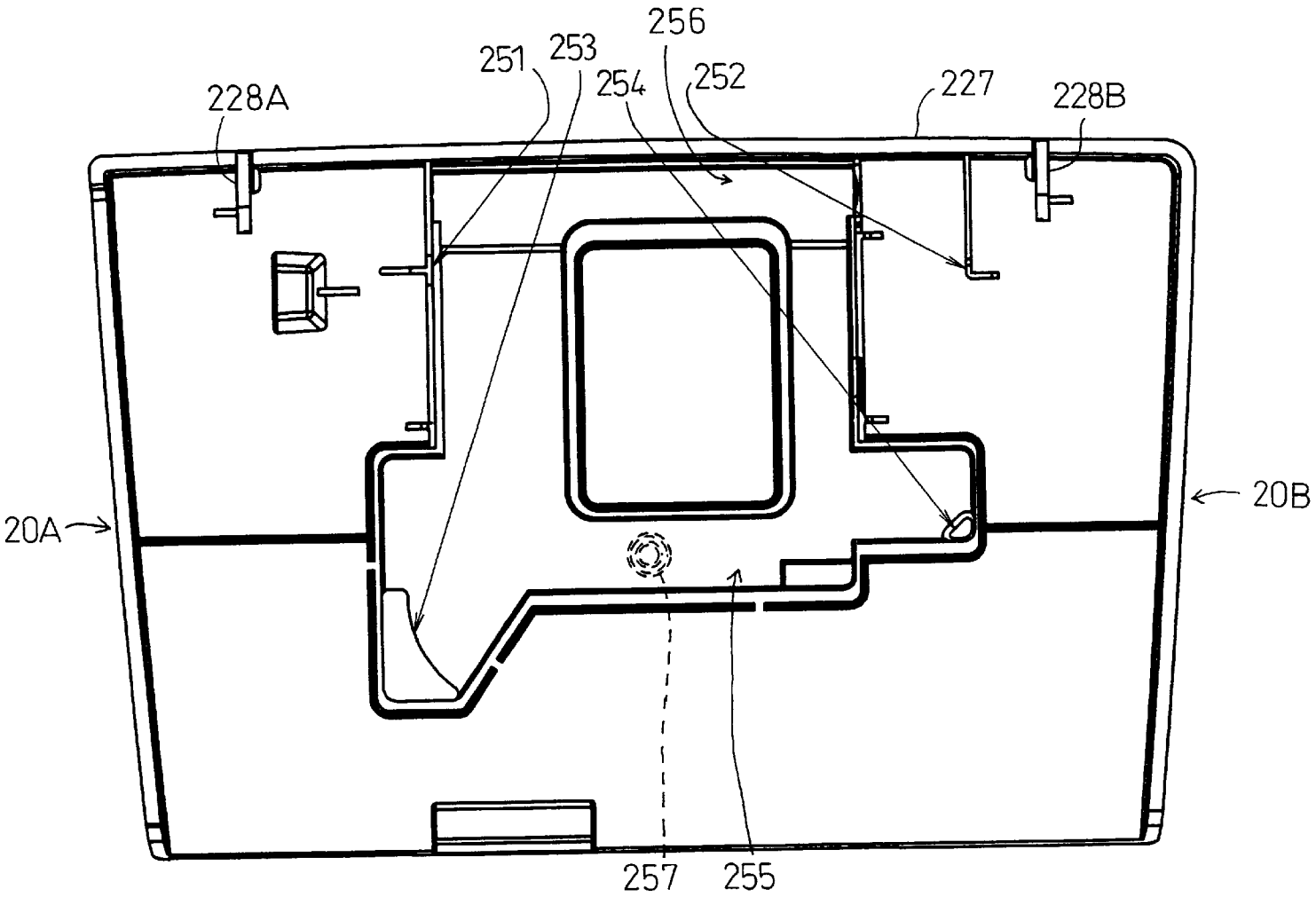
FIG. 20 is a plan view of the inside of a cover.
Figure 21:
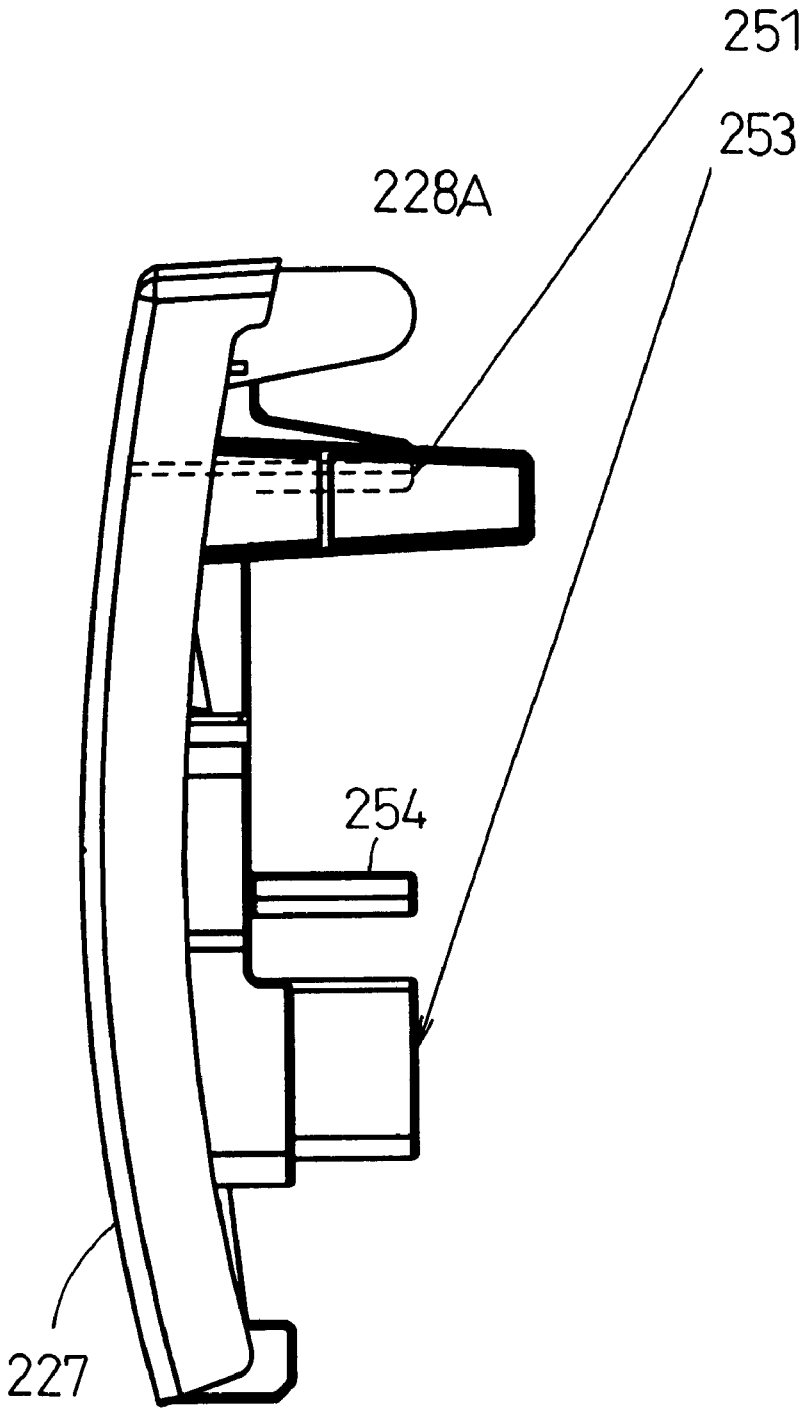
FIG. 21 is a side view of the cover shown in FIG. 20 when viewed from a direction pointed by an arrow 20A.
Figure 22:
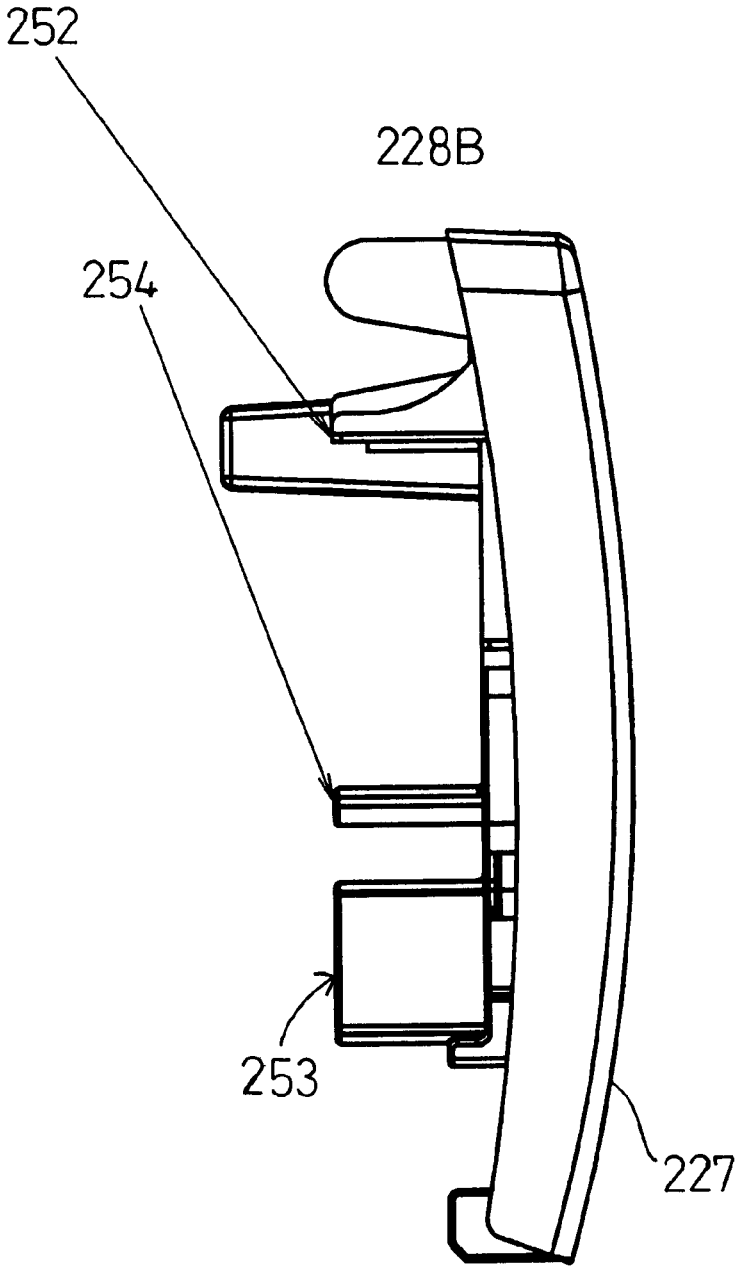
FIG. 22 is a side view of the cover shown in FIG. 20 when viewed from a direction pointed by an arrow 20B.
Figure 23:
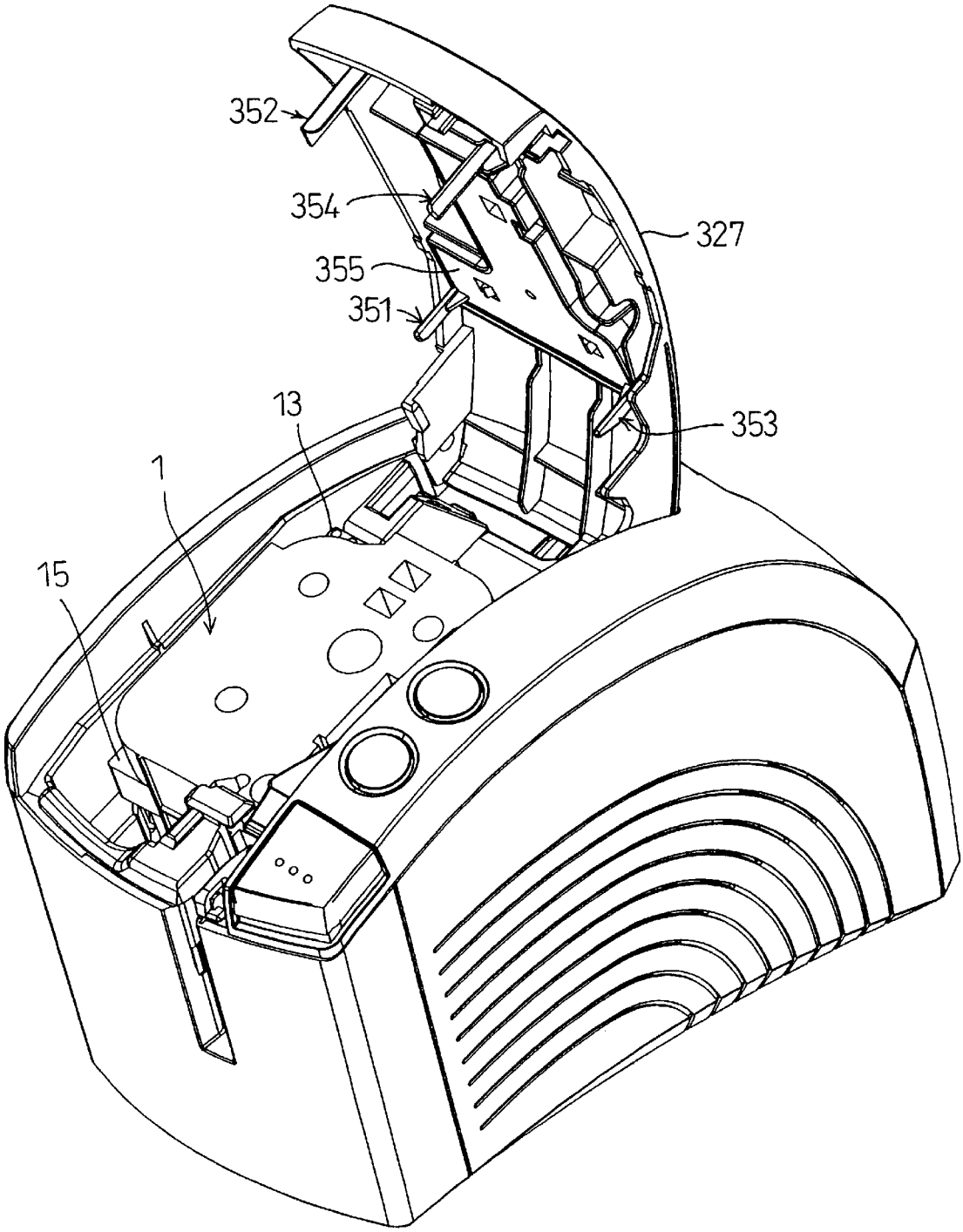
FIG. 23 is a perspective view of a label tape forming device when a cover is opened and the cassette is installed in a cassette accommodating portion of another exemplary embodiment.
Figure 24:
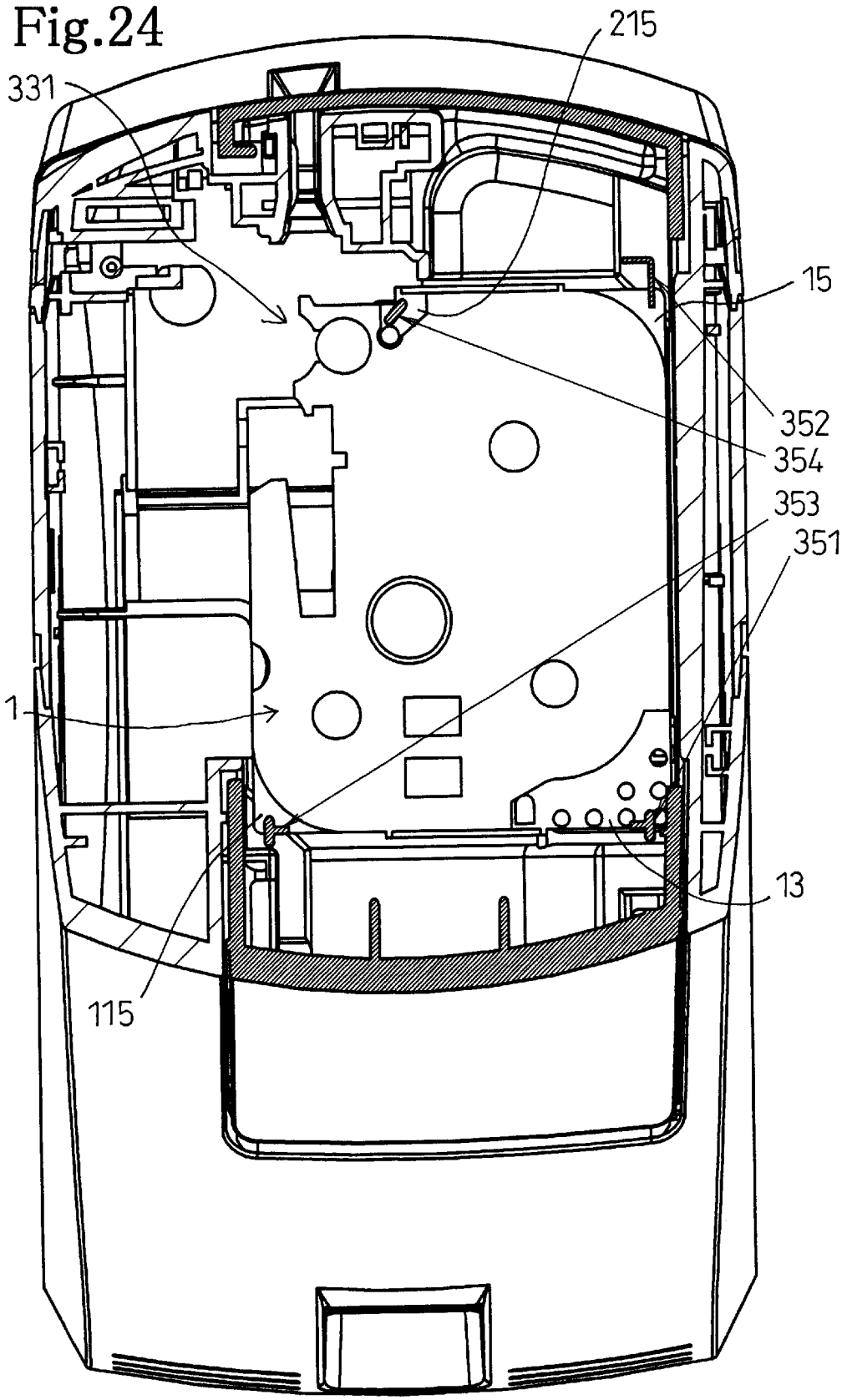
FIG. 24 is a plan view of a body case when the cassette is installed in a cassette accommodating portion.
Figure 25:
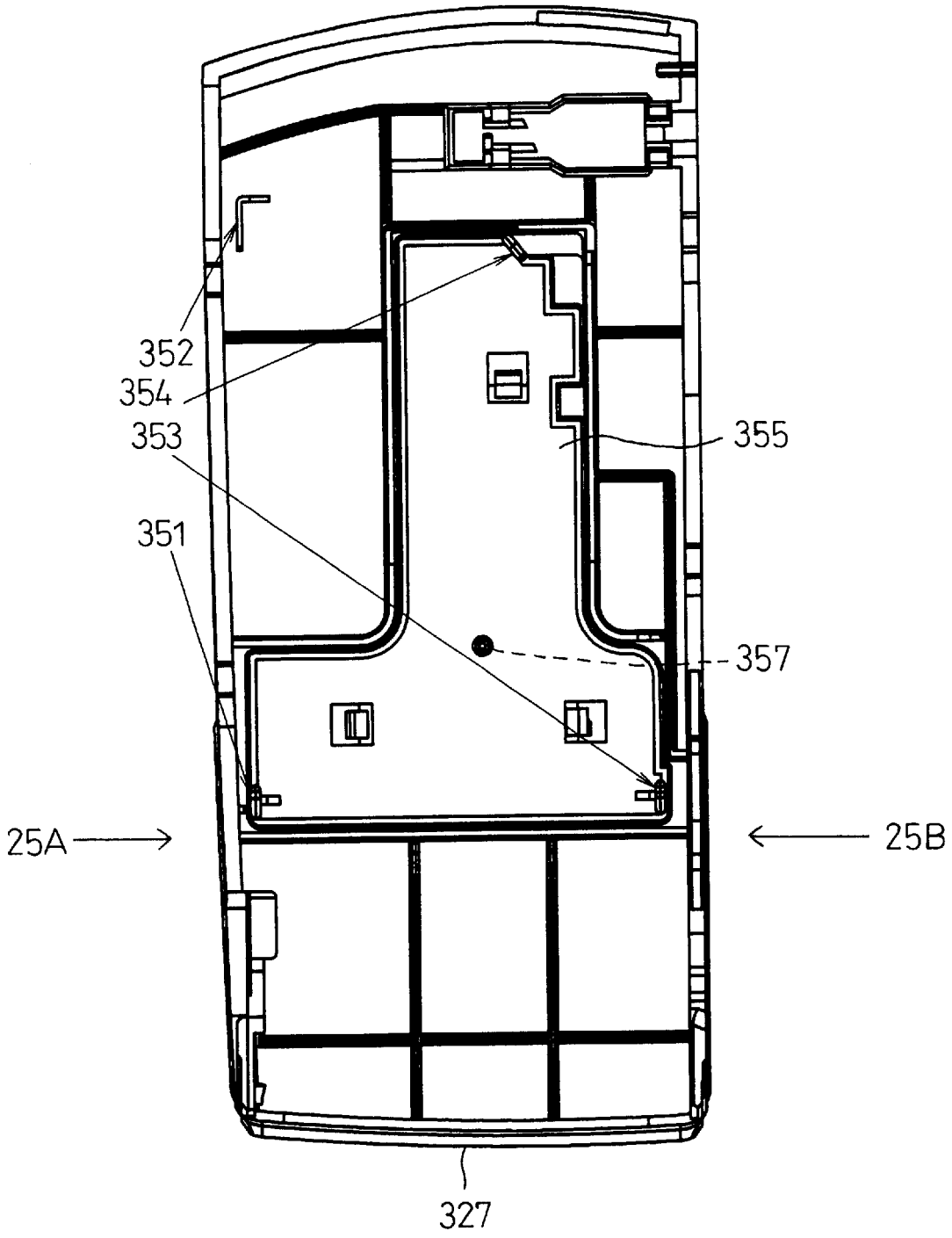
FIG. 25 is a plan view showing the inside of a cover.
Figure 26:
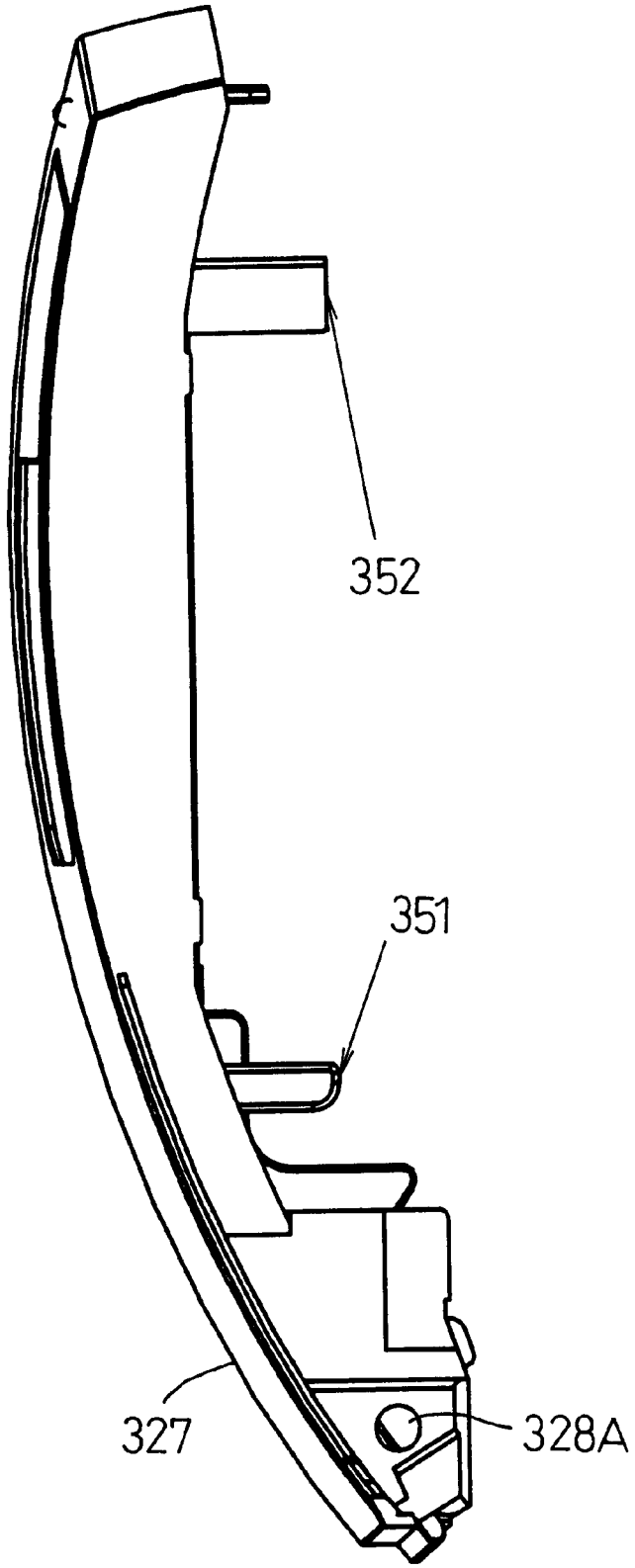
FIG. 26 is a side view of the cover shown in FIG. 25 when viewed from a direction pointed by an arrow 25A.
Figure 27:
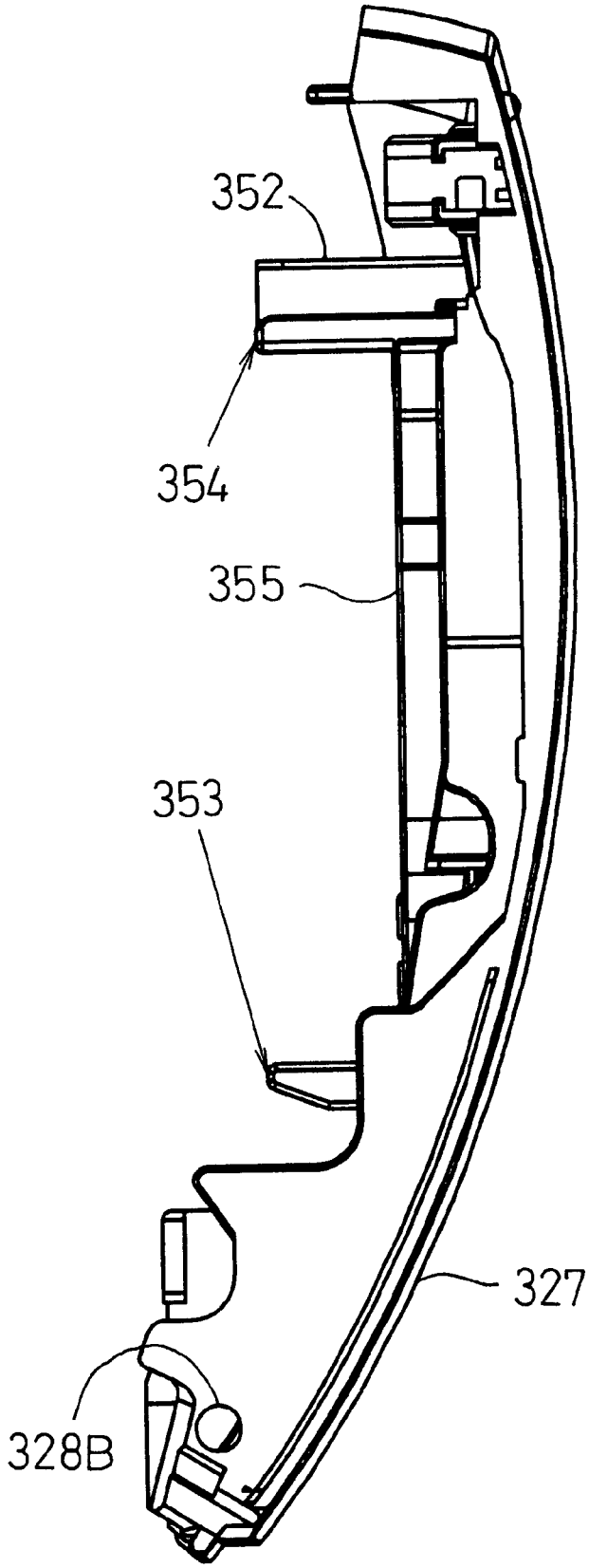
FIG. 27 is a side view of the cover shown in FIG. 25 when viewed from a direction pointed by an arrow 25B.

When the cover 27 is closed, as shown in FIGS. 8 and 14, the first detector portion 13 is pressed downward by the first pressing member 51, so that the tip of the positioning pin 36 contacts the bottom surface of the pin hole 38. As shown in FIGS. 9 and 14, the second detector portion 15 is pressed by the second pressing member 52 and the bottom surface of the second detector portion 15 is certainly supported by the support pin 41. When the cassette 1 is under such a condition, the cassette 1 is installed in the proper position in the horizontal posture. Therefore, the detecting switches 32 are inserted into the switch holes 13A formed in the predetermined position of the first detector portion 13, so that the type of the cassette 1 can be detected. In addition, the cover 27 is completely closed and is on the same plane as the body case 26. Accordingly, a user can immediately determine that the cassette 1 has been installed in the proper position in the proper posture.

Figure 10:
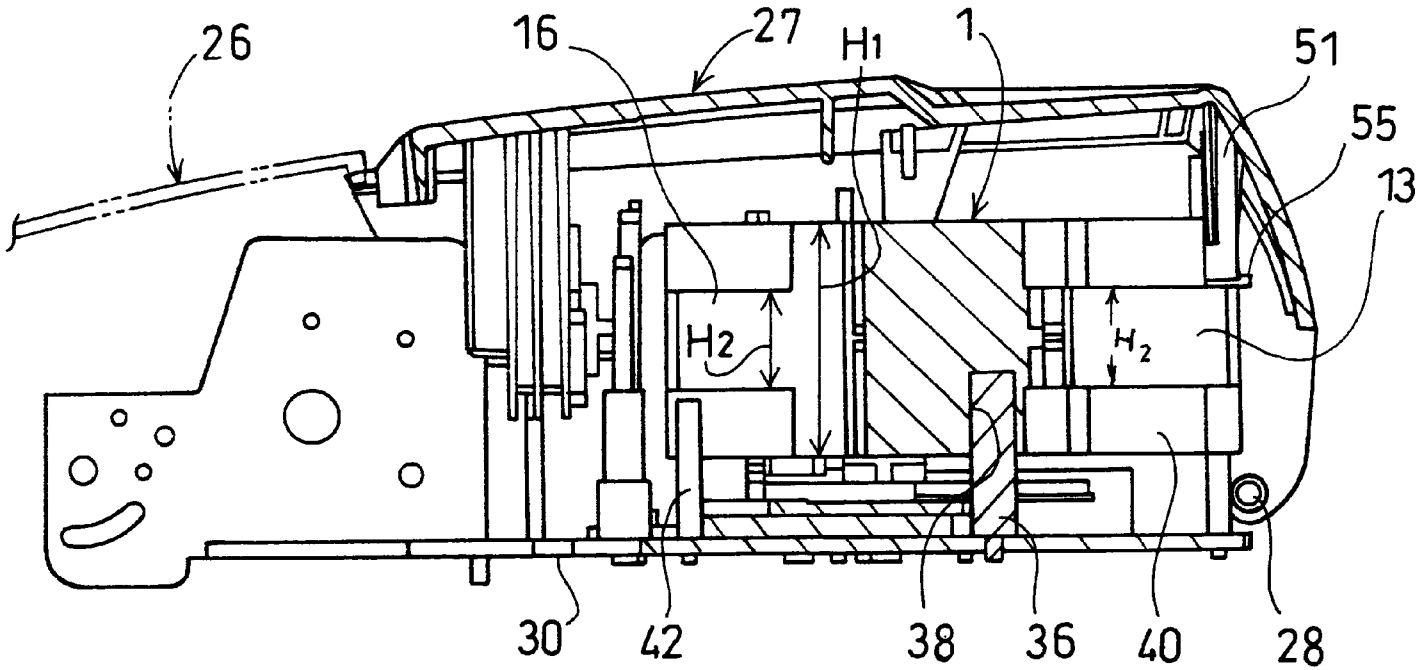
FIG. 10 is a sectional right-side view of the label tape forming device when the cassette accommodating a 24 mm-wide film tape thereof is installed in the cassette accommodating portion in the proper posture.
Figure 11:
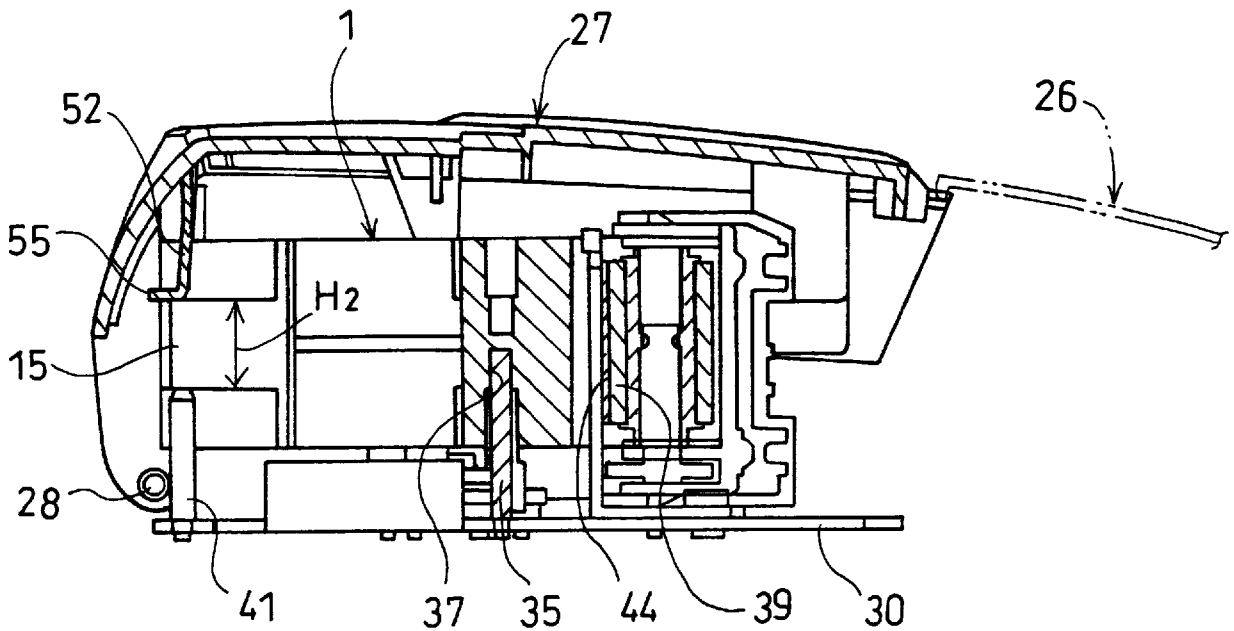
FIG. 11 is a sectional left-side view of the label tape forming device when the cassette accommodating the 24 mm-wide film tape thereof is installed in the cassette accommodating portion in the proper posture.

FIGS. 10 and 11 show the label tape forming device when the cassette 1 accommodating the 24 mm-wide film tape 17 is installed in the proper position in the proper posture. In this case, the cover 27 is also completely closed, so that the user can immediately determine that the cassette 1 has been installed in the proper position in the proper posture.

Figure 12:
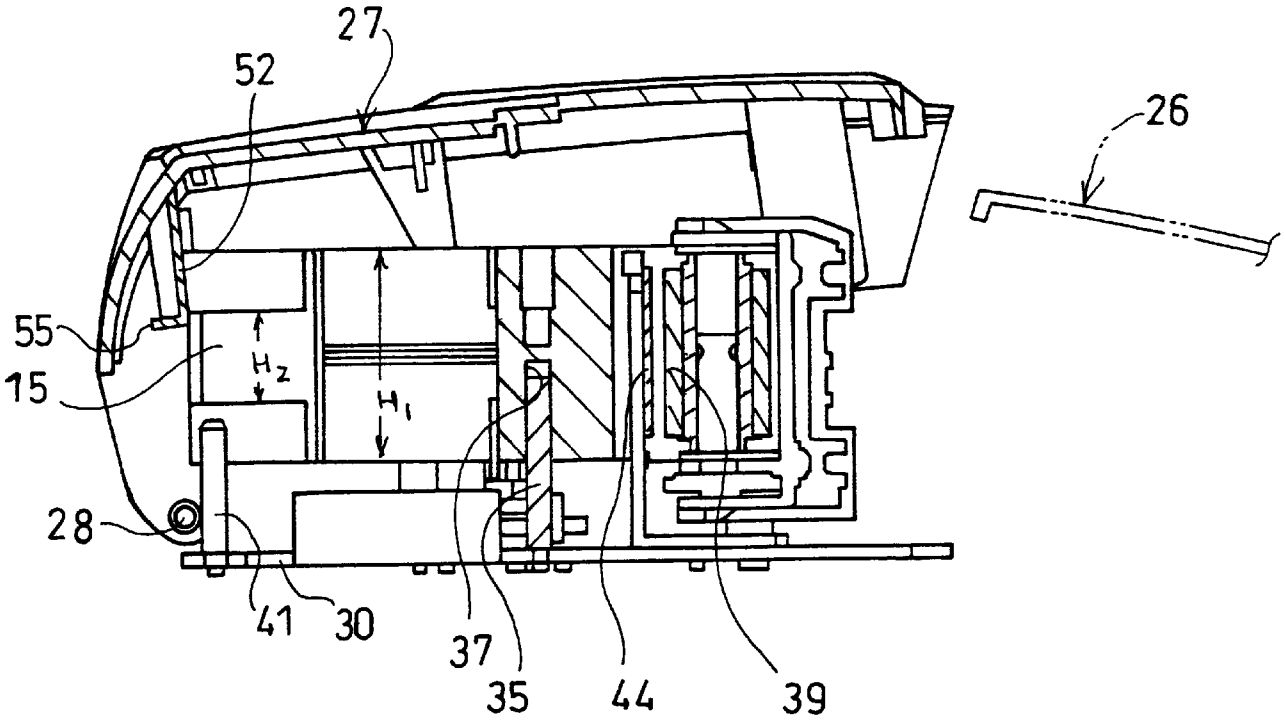
FIG. 12 is a sectional left-side view of the label tape forming device when the cassette accommodating the 24 mm-wide film tape thereof is installed in the cassette accommodating portion in an improper posture.
Figure 13:
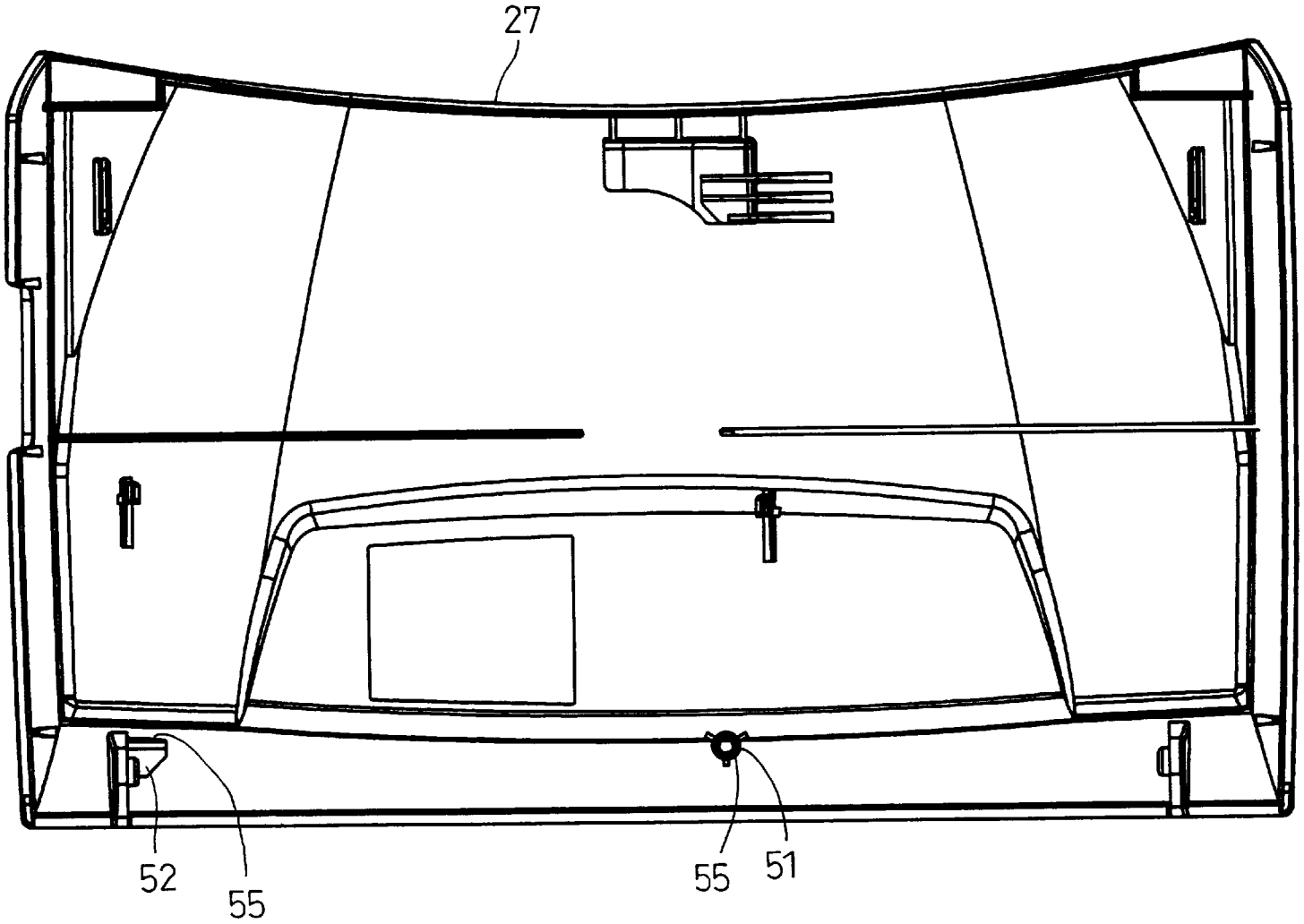
FIG. 13 is a plan view showing the inside of the cover.

FIG. 12 shows the label tape forming device when the cassette 1 is installed in the improper posture that the second detector portion 15 is lifted, such that the cassette 1 inclines against the cassette accommodating portion 31. In this case, the second pressing member 52 can not press the second detector portion 15 at the proper position (the pressing portion 55 of the bottom surface of the second pressing member 52 contacts the corner of the second detector portion 15), so that the cover 27 is half-opened (large space exists between the cover 27 and the body case 26). Therefore, the user can immediately determine that the cassette 1 has been installed in the improper posture.

Likewise, the first pressing member 51 can not press the predetermined portion of the first detector portion 13 when the first detector portion 13 is raised, so that the cover 27 is half-opened. Further, the cover 27 is half-opened when the first detector portion 13 and the second detector portion 15 are both lifted. Therefore, the installation posture of the cassette 1 can be immediately determined.

Next, second through fourth embodiments of the invention will be described with reference to FIGS. 15 through 27. Label tape forming devices of these embodiments each include a cassette accommodating portion for accommodating the same cassette 1 as the first embodiment and perform printing on a tape-shaped recording medium accommodated in the cassette 1 by a printing mechanism similar to the first embodiment. These label tape forming devices also include a cassette installation detecting device that can detect whether the cassette 1 is installed in the cassette accommodating portion in a proper posture. The label tape forming device operates essentially the same as the first embodiment with the exception of the cassette installation detecting device. Therefore, explanation of the label tape forming device will be omitted. The structure of each cassette installation detecting device of these embodiments will be described hereinafter.

First, the cassette installation detecting device according to the second embodiment will be described FIGS. 15 through 18.

A cover 127 covers and uncovers a cassette accommodating portion 131 at the upper portion of the cassette accommodating portion 131 by rotating about hole 128A, 128B as a center of rotation. A first pressing member 151, a second pressing member 152, and a third pressing member 153 protrude downward from the inner surface of the cover 127. The first pressing member 151, the second pressing member 152, and the third pressing member 153 are integrally formed with the cover 127 made from, for example, synthetic resin.

As is the case with the first embodiment, the first pressing member 151 is disposed at the position where the first pressing member 151 can press downward the upper surface of the first detector portion 13 of the cassette 1 installed in the cassette accommodating portion 131 when the cover 127 is completely closed and covers the upper portion of the cassette accommodating portion 131. Likewise, the second pressing member 152 is disposed at the position where the second pressing member 152 can press downward the upper surface of the second detector portion 15 of the cassette 1. The third pressing member 153 is disposed at the position where the third pressing member 153 can press downward the upper surface of a third detector portion 115 of the cassette 1. The first pressing member 151, the second pressing member 152 and the third pressing member 153 each have a pressing portion having a flat surface at their lower end surfaces.

A cassette pressing member 154 is provided to the inner surface of the cover. A pressing portion 155 for pressing the cassette is formed at one end of the cassette pressing member 154. Another end of the cassette pressing member 154 is rotatably supported by a supporting portion 156. The cassette pressing member 154 receives a pressing force from a spring so as to rotate in a direction that the pressing portion 155 urges the cassette 1 installed in the cassette accommodating portion 131. The cassette pressing member 154 is disposed so that the pressing portion 155 can press a position where it is close to a remaining corner other than three corners, on which the first to third detector portions 13, 15, 115 are provided, from a center of the upper surface of the cassette 1 when the cover 127 is completely closed.

Therefore, even when the cassette 1 is inclined in the cassette accommodating portion 131 in some degree, the cassette pressing spring 154 strongly presses the cassette 1 toward the bottom of the cassette accommodating portion 131 upon rotation of the cover 127 in a direction that closes the cover 127. Accordingly, such a structure acts to adjust the posture of the cassette 1 in the cassette accommodating portion 131 to the proper posture.

However, the cassette 1 may not be adjusted even though the pressing force is applied to the cassette 1 from the cassette pressing member 154 because the cassette 1 is quite inclined in the cassette accommodating portion 131. In this case, the cover 127 is closed while at least one of the detector portions 13, 15, 115 is raised because the cassette 1 is installed in the improper posture. Therefore, the pressing member corresponding to the raised detector portion cannot press the raised detector portion at the proper position, as is the case with the first embodiment. Accordingly, the cover 127 is half-opened and thus a user can immediately determine that the cassette 1 is installed in improper posture.

Next, the cassette installation detecting device according to the third embodiment will be described.

A cover 227 covers and uncovers a cassette accommodating portion 231 at the upper portion of the cassette accommodating portion 231 by rotating about rotating portions 228A, 228B as a center of rotation. The cover 227 is made, for example, from synthetic resin. A first pressing member 251, a second pressing member 252, a third pressing member 253, and a fourth pressing member 254 protrude downward from the inner surface of the cover 227.

The first pressing member 251 and the second pressing member 252 are directly fixed to the inner surface of the cover 227. The third pressing member 253 and the fourth pressing member 254 are provided to the inner surface of the cover 227 via a pressing plate 255.

The pressing plate 255 is pivotally supported at its end portion 256 on the inner surface of the cover 227 so that the pressing plate 255 can be pivotally movable at the end portion 256. The pressing plate 255 is urged by a spring 257 toward the cassette 1 installed in the cassette accommodating portion 231. Therefore, the third pressing member 253 and the fourth pressing member 254 are urged toward the cassette 1 installed in the cassette accommodating portion 231, together with the pressing plate 255. With this structure, as the cover 227 is closed at the upper portion of the cassette accommodating portion 231, the third pressing member 253 and the fourth pressing member 254 urge the cassette 1 toward the cassette accommodating portion 231 together with the pressing plate 255 urged toward the cassette 1 by the spring 257. Accordingly, even when the cassette 1 is installed in the cassette accommodating portion 231 deviating from a proper position in some degree and the cover 227 is closed, the third pressing member 253 and the fourth pressing member 254 can press the cassette 1 toward the proper position.

As is the case with the first embodiment, when the cover 227 is completely closed and covers the upper portion of the cassette accommodating portion 231, the first pressing member 251 is disposed at the position where the first pressing member 251 can press downward the upper surface of the first detector portion 13 of the cassette 1 installed in the cassette accommodating portion 31. The second pressing member 252 is disposed at the position where the second pressing member 252 can press downward the upper surface of the second detector portion 15 of the cassette 1. Further, the third pressing member 253 and the fourth pressing member 254 are each disposed at position where the third pressing member 253 and the fourth pressing member 254 can press downward the upper surfaces of the third detector portion 115 and the fourth detector portion 215, respectively. The first pressing member 251, the second pressing member 252, the third pressing member 253, and the fourth pressing member 254 each have a pressing portion having a flat surface at their lower end surfaces.

The first pressing member 251 and the second pressing member 252 are fixedly provided to the inner surface of the cover 227, while the third pressing member 253 and the fourth pressing member 254 are provided to the pressing plate 255 which is supported to be pivotally movable. With this structure, the posture of the cassette 1 can be more precisely detected whether the cassette 1 is installed in the cassette accommodating portion 231 in the proper position. Therefore, at least one of the pressing members is preferably fixedly provided to the inner surface of the cover 227 like the first pressing member 251 and the second pressing member 252 as described above.

When the cassette 1 is inclined in the cassette accommodating portion 231 and at least one of the detector portions 13, 15, 115, 215 of the cassette 1 is raised, the pressing member corresponding to the raised detector portion cannot press the detector portion at the proper position. Therefore, as is the case with the first and second embodiments, the cover 227 is half opened and thus the user can immediately determined that the cassette 1 is installed in the improper posture.

Next, the cassette installation detecting device according to the fourth embodiment will be described with reference to FIGS. 23 through 27.

A cover 327 covers and uncovers a cassette accommodating portion 331 at the upper portion of the cassette accommodating portion 331 by rotating about rotating portions 328A, 328B as a center of rotation. The cover 327 is made, for example, from synthetic resin. A first pressing member 351, a second pressing member 352, a third pressing member 353, and a fourth pressing member 354 protrude downward from the inner surface of the cover 327.

The structure of the fourth embodiment is similar to the third embodiment. The second pressing member 352 is directly fixed to the inner surface of the cover 327. The first pressing member 351, the third pressing member 353 and the fourth pressing member 354 are provided to the inner surface of cover 327 via a pressing plate 355.

The pressing plate 355 is urged by a spring 357 toward the cassette 1 installed in the cassette accommodating portion 331. Therefore, the first pressing member 351, the third pressing member 353 and the fourth pressing member 354 are urged toward the cassette 1 installed in the cassette accommodating portion 331, together with the pressing plate 355.

As is the case with the first embodiment, when the cover 327 is completely closed and covers the upper portion of the cassette accommodating portion 331, the first pressing member 351 is disposed at the position where the first pressing member 351 can press downward the upper surface of the first detector portion 13 of the cassette 1 installed in the cassette accommodating portion 331. The second pressing member 352 is disposed at the position where the second pressing member 352 can press downward the upper surface of the second detector portion 15 of the cassette 1. Further, the third pressing member 353 and the fourth pressing member 354 are each disposed at position where the third pressing member 353 and the fourth pressing member 354 can press downward the upper surfaces of the third detector portion 115 and the fourth detector portion 215, respectively. The first pressing member 351, the second pressing member 352, the third pressing member 353, and the fourth pressing member 354 each have a pressing portion having a flat surface at their lower end surfaces.

When the cassette 1 is inclined in the cassette accommodating portion 331 and at least one of the detector portions 13, 15, 115, 215 of the cassette 1 is raised, the pressing member corresponding to the raised detector portion cannot press the detector portion at the proper position. Therefore, as is the case with the first and second embodiments, the cover 327 is half opened and thus the user can immediately determined that the cassette 1 is installed in the improper posture.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A cassette installation detecting device used in a printer that prints on a recording medium accommodated in a cassette at a printing portion, the cassette having a substantially rectangular parallelpiped shape defining a length that is longer than a width, the cassette including a first corner, a second corner, a first detector portion and a second detector portion, the first detector portion being formed at the first corner and the second detector portion being formed at the second corner, the first corner being separated from the second corner by the length of the cassette, the cassette installation detecting device comprising:

a cassette accommodating portion having an accommodating surface that accommodates the cassette with the accommodating surface opposed to the cassette, the cassette accommodating at least one of the recording medium and an ink ribbon therein, the cassette accommodating portion defining first and second detector positions that are spaced from each other;

a cover that moves between at least a first position where the cover opposes the accommodating surface and covers the cassette accommodating portion and a second position where the cover uncovers the cassette accommodating portion; and first and second pressing members that are formed on the cover at positions such that they move into the corresponding detector positions from positions spaced from the corresponding detector positions when the cover moves to the first position;

wherein, when the cover is in the first position, the first pressing member presses the first detector portion of the cassette, accommodated in the cassette accommodating portion, toward the accommodating surface, and the second pressing member presses the second detector portion of the cassette, accommodated in the cassette accommodating portion, toward the accommodating surface.

2. The cassette installation detecting device according to claim 1, wherein the first and second detector portions of the cassette each define a first detector surface and a second detector surface opposite to the first detector surface, the first detector surfaces of first and second detector portions being on a first side of the cassette and the second detector surfaces of the first and second detector portions being on a second side of the cassette, the cassette installation detecting device further comprising:

a detecting portion that detects the first detector portion of the cassette from the first detector surface, the first detector surface of the cassette facing the accommodating surface when the cassette is accommodated in the cassette accommodating portion, and the second detector surface of the cassette facing the cover when the cover moves to the first position, wherein, when the cassette is installed in a proper position in the cassette accommodating portion, the cassette accommodating portion accommodates the cassette at a position where the first detector portion and the second detector portion of the cassette are located at corresponding detector positions, the first detector surface of the first detector portion of the cassette communicates with the detecting portion, and the second detector surface of the first and second detector portions of the cassette communicate with the first and second pressing members.

3. The cassette installation detecting device according to claim 2, wherein the first detector portion indicates a type of the cassette.

4. The cassette installation detecting device according to claim 2, wherein the cover is prevented from closing at the first position by an interference with at least one of the first pressing member and the second pressing member against the cassette when the cassette is not installed in a proper position in the cassette accommodating portion.

5. The cassette installation detecting device according to claim 4, wherein the cassette defines at least one aperture and a recess that are both defined at a region of the cassette spaced from the first and second detector positions of the cassette accommodating portion when the cassette is accommodated in the cassette accommodating portion, and wherein the printer defines at least one capstan that extends within the at least one aperture of the cassette and a head that extends within the recess of the cassette.

6. The cassette installation detecting device according to claim 1, wherein the printer comprises a body case and the cover and the cassette accommodating portion is provided in the body case.

7. The cassette installation detecting device according to claim 1, wherein the second pressing member is fixed on the cover.

8. The cassette installation detecting device according to claim 7, wherein the first pressing member is pushed elastically from the cover toward the accommodating surface by an elastic member.

9. The cassette installation device according to claim 7, wherein the first pressing member is fixed on the cover.

10. A cassette that can be installed in a printer, the printer having a first pressing member, a second pressing member, a cassette accommodating portion and a cover movable at least between a first position where the cover covers the accommodating position and a second position where the cover uncovers the cassette accommodating portion, the first and second pressing members being formed on the cover, the cassette comprising:

a first corner;

a second corner which is separated from the first corner by a length of the cassette which is longer than a width of the cassette:

a first detector portion formed at the first corner;

a second detector portion formed at the second corner; and at least one of a recording medium and an ink ribbon;

wherein the first detector portion and the second detector portion are formed at a same height in the width direction of the at least one of the recording medium and the ink ribbon regardless of the width of the recording medium; and wherein, when the cover is in the first position, the first pressing member of the printer presses the first detector portion of the cassette, accommodated in the cassette accommodating portion, toward the accommodating surface, and the second pressing member of the printer presses the second detector portion of the cassette accommodated in the cassette accommodating portion toward the accommodating surface.

11. The cassette according to claim 10, wherein the first detector portion and the second detector portion are formed on a side adjacent to a center of rotation of the cover when the cassette is installed in the accommodating portion.

12. A printer that prints on a recording medium accommodated in a cassette at a printing portion, the cassette having a substantially rectangular parallelpiped shape defining a length that is longer than a width, the cassette including a first corner, a second corner, a first detector portion and a second detector portion, the first detector portion being formed at the first corner and the second detector portion being formed at the second corner, the first corner being separated from the second corner by the length of the cassette, the printer comprising a cassette installation detecting device comprising:

a cassette accommodating portion having an accommodating surface that accommodates the cassette with the accommodating surface opposed to the cassette, the cassette accommodating at least one of the recording medium and an ink ribbon therein, the cassette accommodating portion defining first and second detector positions that are spaced from each other;

a cover that moves between at least a first position where the cover opposes the accommodating surface and covers the cassette accommodating portion and a second position where the cover uncovers the cassette accommodating portion; and first and second pressing members that are formed on the cover at positions such that they move into the corresponding detector positions from positions spaced from the corresponding detector positions when the cover moves to the first position;

wherein, when the cover is in the first position, the first pressing member presses the first detector portion of the cassette, accommodated in the cassette accommodating portion, toward the accommodating surface, and the second pressing member presses the second detector portion of the cassette, accommodated in the cassette accommodating portion, toward the accommodating surface.

13. The printer according to claim 12, wherein the first and second detector portions of the cassette each define a first detector surface and a second detector surface opposite to the first detector surface, the first detector surfaces of the first and second detector portions being on a first side of the cassette and the second detector surfaces of the first and second detector portions being on a second side of the cassette, the printer further comprising:

a detecting portion that detects the first detector portion of the cassette from the first detector surface, the first detector surface of the cassette facing the accommodating surface when the cassette is accommodated in the cassette accommodating portion, and the second detector surface of the cassette facing the cover when the cover moves to the first position, wherein, when the cassette is installed in a proper position in the cassette accommodating portion, the cassette accommodating portion accommodates the cassette at a position where the first detector portion and the second detector portion of the cassette are located at corresponding detector positions, the first detector surface of the first detector portion of the cassette communicates with the detecting portion, and the second detector surface of the first and second detector portions communicate with the first and second pressing members.

14. The printer according to claim 13, wherein the first detector portion indicates a type of the cassette.

15. The printer according to claim 13, wherein the cover is prevented from closing at the first position by an interference with at least one of the first pressing member and the second pressing member against the cassette when the cassette is not installed in a proper position in the cassette accommodating portion.

16. The printer according to claim 15, wherein the cassette defines at least one aperture and a recess that are both defined at a region of the cassette spaced from the first and second detector positions of the cassette accommodating portion when the cassette is accommodated in the cassette accommodating portion, and wherein the printer defines at least one capstan that extends within the at least one aperture of the cassette and a head that extends within the recess of the cassette.

17. The cassette installation detecting device according to claim 4, wherein the cassette includes third and fourth corners and third and fourth detector portions that are formed at the third and fourth corners, respectively, and the cassette installation detecting device includes third and fourth pressing members that are formed on the cover at positions such that they move into the corresponding detector positions from positions spaced from the corresponding detector positions when the cover moves to the first position.

18. The printer according to claim 15, wherein the cassette includes third and fourth corners and third and fourth detector portions that are formed at the third and fourth corners, respectively, and the cassette installation detecting device includes third and fourth pressing members that are formed on the cover at positions such that they move into the corresponding detector positions from positions spaced from the corresponding detector positions when the cover moves to the first position.

19. The printer according to claim 12, wherein the printer comprises a body case and the cover and the cassette accommodating portion is provided in the body case.

20. The printer according to claim 12, wherein the second pressing member is fixed on the cover.

21. The printer according to claim 20, wherein the first pressing member is pushed elastically from the cover toward the accommodating surface by an elastic member.

22. The printer according to claim 20, wherein the first pressing member is fixed on the cover.

23. A printer, comprising:

a cassette that accommodates a recording medium, the cassette having a substantially rectangular parallelpiped shape, the cassette including a first corner and a first detector portion, the first detector portion being formed at the first corner; and a cassette installation detecting device that includes:

a cassette accommodating portion having an accommodating surface that accommodates the cassette with the accommodating surface opposed to the cassette, the cassette accommodating at least one of the recording medium and an ink ribbon therein, the cassette accommodating portion defining a first detector position;

a cover that moves between at least a first position where the cover opposes the accommodating surface and covers the cassette accommodating portion and a second position where the cover uncovers the cassette accommodating portion, the first detector portion being formed on a side adjacent to a center of rotation of the cover, and located adjacent to the center of rotation of the cover, when the cassette is installed in the accommodating portion; and a first pressing member that is formed on the cover at a position such that it moves into the first detector position from a position spaced from the first detector position when the cover moves to the first position;

wherein, when the cassette is disposed at an improper position at the cassette accommodating portion, the first pressing member is unable to press the first detector portion of the cassette toward the accommodating surface, such that the cover cannot be moved to the first position.

24. The cassette installation detecting device according to claim 23, wherein the first pressing member contacts a corner of the detector portion when the cassette is disposed at an improper position at the cassette accommodating portion.

25. The printer according to claim 24, wherein the cassette defines a length that is longer than a width, and includes a second corner and a second detector portion formed at the second corner, the first corner being separated from the second corner by the length of the cassette, and wherein the cassette installation detecting device includes a second detector position defined by the accommodating portion and a second pressing member that is formed on the cover such that it moves into the second detector position from a position spaced from the second detector position when the cover moves to the first position.

26. The printer according to claim 25, wherein, when the cover is in the first position, the first pressing member presses the first detector portion of the cassette, accommodated in the cassette accommodating portion, toward the accommodating surface, and the second pressing member presses the second detector portion of the cassette, accommodated in the cassette accommodating portion, toward the accommodating surface.

27. The printer according to claim 26, wherein the first and second detector portions of the cassette each define a first detector surface and a second detector surface opposite to the first detector surface, the first detector surfaces of first and second detector portions being on a first side of the cassette and the second detector surfaces of the first and second detector portions being on a second side of the cassette, the cassette installation detecting device further comprising:

a detecting portion that detects the first detector portion of the cassette from the first detector surface, the first detector surface of the cassette facing the accommodating surface when the cassette is accommodated in the cassette accommodating portion, and the second detector surface of the cassette facing the cover when the cover moves to the first position, wherein, when the cassette is installed in a proper position in the cassette accommodating portion, the cassette accommodating portion accommodates the cassette at a position where the first detector portion and the second detector portion of the cassette are located at corresponding detector positions, the first detector surface of the first detector portion of the cassette communicates with the detecting portion, and the second detector surface of the first and second detector portions of the cassette communicate with the first and second pressing members.

* * * * *